US012578134B2

(12) United States Patent
Kwak

(10) Patent No.: US 12,578,134 B2
(45) Date of Patent: Mar. 17, 2026

(54) AIR CONDITIONER FOR REMOVING FOREIGN SUBSTANCES FROM INDOOR HEAT EXCHANGER AND METHOD OF OPERATING THE SAME

(71) Applicant: LG ELECTRONICS INC., Seoul (KR)

(72) Inventor: Minsuk Kwak, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 273 days.

(21) Appl. No.: 18/268,674

(22) PCT Filed: Dec. 13, 2021

(86) PCT No.: PCT/KR2021/018867
§ 371 (c)(1),
(2) Date: Jun. 21, 2023

(87) PCT Pub. No.: WO2022/139291
PCT Pub. Date: Jun. 30, 2022

(65) Prior Publication Data

US 2023/0366601 A1 Nov. 16, 2023

(30) Foreign Application Priority Data

Dec. 23, 2020 (KR) ..... 10-2020-0181649

(51) Int. Cl.
*F24F 3/14* (2006.01)
*F25B 49/02* (2006.01)
*F24F 13/22* (2006.01)

(52) U.S. Cl.
CPC ..... *F25B 49/022* (2013.01); *F24F 3/1405* (2013.01); *F24F 13/222* (2013.01);
(Continued)

(58) Field of Classification Search
CPC ..... F24F 3/1405; F24F 2221/225
See application file for complete search history.

(56) References Cited

U.S. PATENT DOCUMENTS 5,649,428 A * 7/1997 Calton ..... F24F 12/003 62/94
6,516,622 B1 * 2/2003 Wilson ..... F04C 28/08 62/228.3

(Continued)

FOREIGN PATENT DOCUMENTS

CN 107514683 12/2017
CN 109373504 2/2019

(Continued)

OTHER PUBLICATIONS

Korean Office Action dated Nov. 30, 2023 issued in Application No. 10-2022-0175932.

(Continued)

*Primary Examiner* — Jerry-Daryl Fletcher
*Assistant Examiner* — Daniel C Comings
(74) *Attorney, Agent, or Firm* — KED & ASSOCIATES

(57) ABSTRACT

An air conditioner is provided that includes a compressor that compresses and discharges a refrigerant; an indoor heat exchanger that exchanges heat between the refrigerant and indoor air; a sensor unit including at least one sensor; and a controller. The controller performs a primary control of the compressor, based on a first target temperature corresponding to a dew point temperature of the indoor air and a current temperature of the indoor heat exchanger, performs a secondary control of the compressor, based on a second target temperature below zero lower than the first target temperature and the current temperature of the indoor heat exchanger, and determines whether to repeatedly perform at (Continued)

least one of the primary control or the secondary control, based on an amount of moisture contained in the indoor air.

20 Claims, 15 Drawing Sheets

(52) U.S. Cl.
CPC ..... *F25B 2600/0253* (2013.01); *F25B 2600/2513* (2013.01); *F25B 2700/02* (2013.01); *F25B 2700/2104* (2013.01)

(56) References Cited

U.S. PATENT DOCUMENTS

| | | | | |
|---|---|---|---|---|
| 2004/0134206 | A1* | 7/2004 | Lee | F25B 49/022 62/223 |
| 2012/0291463 | A1* | 11/2012 | O'Brien | F24F 3/1405 62/126 |
| 2015/0007598 | A1* | 1/2015 | Choi | F25B 1/10 62/190 |
| 2019/0353407 | A1* | 11/2019 | Miyakoshi | B60H 1/0005 |
| 2021/0348811 | A1* | 11/2021 | Shanmugam | F25B 43/02 |

FOREIGN PATENT DOCUMENTS

| | | | |
|---|---|---|---|
| CN | 110762749 | 2/2020 | |
| JP | 2010-014288 | 1/2010 | |
| JP | 5040981 | 10/2012 | |
| JP | 2018-200128 | 12/2018 | |
| JP | 2020-060362 | 4/2020 | |
| KR | 10-2012-0128888 | 11/2012 | |
| KR | 10-1282038 | 7/2013 | |
| KR | 10-1689724 | 1/2017 | |
| WO | WO 2018/198390 | 11/2018 | |
| WO | WO-2020070891 A1 * | 4/2020 | F24F 11/30 |

OTHER PUBLICATIONS

Korean Notice of Allowance issued in Application No. 10-2022-0175932 dated Aug. 26, 2024.
International Search Report dated Apr. 19, 2022 issued in Application No. PCT/KR2021/018867.

* cited by examiner

AIR CONDITIONER FOR REMOVING FOREIGN SUBSTANCES FROM INDOOR HEAT EXCHANGER AND METHOD OF OPERATING THE SAME

CROSS-REFERENCE TO RELATED PATENT APPLICATIONS

This application is a U.S. National Stage Application under 35 U.S.C. § 371 of PCT Application No. PCT/KR2021/018867, filed Dec. 13, 2021, which claims priority to Korean Patent Application No. 10-2020-0181649, filed Dec. 23, 2020, whose entire disclosures are hereby incorporated by reference.

TECHNICAL FIELD

The present disclosure relates to an air conditioner and an operating method thereof, and more particularly, to an air conditioner capable of removing foreign substances adsorbed to an indoor heat exchanger and an operating method thereof.

BACKGROUND ART

Air conditioners are installed to provide a more comfortable indoor environment to humans by discharging cold and hot air into a room to adjust an indoor temperature and to purify an indoor air, in order to create a comfortable indoor environment. In general, an air conditioner includes an indoor unit configured of a heat exchanger and installed indoors, and an outdoor unit configured of a compressor, a heat exchanger, and the like to supply refrigerant to the indoor unit.

The air conditioner operates in a cooling operation or a heating operation according to the flow of the refrigerant. During cooling operation, a high-temperature, high-pressure liquid refrigerant is supplied to the indoor unit from the compressor of the outdoor unit through the heat exchanger of the outdoor unit, the temperature of the ambient air decreases as the refrigerant expands and vaporizes in the heat exchanger of the indoor unit, and cool air is discharged into the room as a fan of the indoor unit rotates. During heating operation, a high-temperature, high-pressure gaseous refrigerant is supplied to the indoor unit from the compressor of the outdoor unit, and the air heated by an energy emitted when the high-temperature, high-pressure gaseous refrigerant is liquefied in the heat exchanger of the indoor unit is discharged into the room according to the operation of an indoor unit fan.

Meanwhile, while the air conditioner is operating, foreign substances such as dust may be adsorbed to the heat exchanger of the indoor unit, or the like. For example, while the air conditioner performs a cooling operation, condensed water may be generated by heat exchange between a refrigerant and indoor air in the heat exchanger of the indoor unit. At this time, when some of the condensed water is formed on the surface of the heat exchanger or remains in a drain pipe through which the condensed water is discharged, foreign substances, and the like may be adsorbed to the condensed water.

As described above, when foreign substances are adsorbed to the heat exchanger of the indoor unit, or the like, microorganisms such as bacteria and fungi may propagate due to the foreign substances, which may cause discomfort to a user and adversely affect a user's health. Therefore, various studies have been conducted for the removal of foreign substances.

In order to remove foreign substances adsorbed to the heat exchanger of the indoor unit, as in Prior Art 1 (Japanese Laid-Open Patent Publication No. 2010-014288), a conventional air conditioner form frost on the surface of the heat exchanger of the indoor unit by using a refrigerant cycle, and then, performs a defrosting operation to remove the frost formed on the surface of the heat exchanger. At this time, as the water formed on the surface of the heat exchanger by the defrosting operation flows and is drained, foreign substances adsorbed to the heat exchanger of the indoor unit may be removed together with the water.

In addition, as in Prior Art 2 (Japanese Laid-Open Patent Publication No. 2018-200128), the conventional air conditioner operates so that water droplets are first condensed on the surface of the heat exchanger of the indoor unit before frost is formed on the surface of the heat exchanger. Accordingly, it may also operate to drain a larger amount of water when removing foreign substances.

DISCLOSURE

Technical Problem

The present disclosure has been made in view of the above problems, and provides an air conditioner capable of increasing the amount of moisture condensed in an indoor heat exchanger for removing foreign substances adsorbed to an indoor heat exchanger, and an operating method thereof.

The present disclosure further provides an air conditioner capable of preventing damage to a compressor that may occur while removing foreign substances adsorbed to an indoor heat exchanger, and an operating method thereof.

The present disclosure further provides an air conditioner capable of uniformly removing foreign substances with respect to an entire area of an indoor heat exchanger, and an operating method thereof.

The present disclosure further provides an air conditioner capable of determining whether to repeat an operation of removing foreign substances adsorbed to an indoor heat exchanger, in consideration of a state of indoor air, and an operating method thereof.

Technical Solution

In order to achieve the above object, an air conditioner according to various embodiments of the present disclosure removes foreign substances adsorbed on an indoor heat exchanger, by adjusting the operating frequency of a compressor based on at least one of a dew point temperature of indoor air and a compression ratio of the compressor.

In order to achieve the above object, an air conditioner according to various embodiments of the present disclosure includes a compressor which compresses and discharges a refrigerant; an indoor heat exchanger that exchanges heat between the refrigerant and an indoor air; a sensor unit including at least one sensor; and a controller, wherein the controller performs a primary control of the compressor, based on a first target temperature corresponding to a dew point temperature of the indoor air and a current temperature of the indoor heat exchanger, performs a secondary control of the compressor, based on a second target temperature below zero lower than the first target temperature and the current temperature of the indoor heat exchanger, and determines whether to repeatedly perform at least one of the primary control and the secondary control, based on an amount of moisture contained in the indoor air.

In order to achieve the above object, an operating method of air conditioner according to various embodiments of the present disclosure includes performing a primary control of a compressor included in the air conditioner, based on a first target temperature corresponding to a dew point temperature of an indoor air and a current temperature of an indoor heat exchanger included in the air conditioner; performing a secondary control of the compressor, based on a second target temperature below zero lower than the first target temperature and the current temperature of the indoor heat exchanger; and determining whether to repeatedly perform at least one of the primary control and the secondary control, based on an amount of moisture contained in the indoor air.

Advantageous Effects

According to at least one of the embodiments of the present disclosure, the amount of moisture condensed in the indoor heat exchanger can be increased by adjusting the operating frequency of the compressor to correspond to the dew point temperature of indoor air.

In addition, according to at least one of the embodiments of the present disclosure, damage to the compressor that may occur during freezing of moisture condensed in the indoor heat exchanger can be prevented by adjusting the operating frequency of the compressor based on the compression ratio of the compressor.

In addition, according to at least one of the embodiments of the present disclosure, moisture can be uniformly frozen in the entire area of the indoor heat exchanger, and foreign substances can be uniformly removed with respect to the entire area of the indoor heat exchanger.

In addition, according to at least one of the embodiments of the present disclosure, the foreign substances adsorbed to the indoor heat exchanger can be more effectively removed by repeating the operation of removing the foreign substances adsorbed to the indoor heat exchanger, according to the amount of moisture contained in the indoor air.

Further scope of applicability of the present disclosure will become apparent from the following detailed description. However, it should be understood that the detailed description and specific embodiments such as preferred embodiments of the present disclosure are given by way of illustration only, since various changes and modifications within the spirit and scope of the present disclosure may be clearly understood by those skilled in the art.

MODE FOR INVENTION

Description will now be given in detail according to exemplary embodiments disclosed herein, with reference to the accompanying drawings. For the sake of brief description with reference to the drawings, the same or equivalent components may be denoted by the same reference numbers, and description thereof will not be repeated.

In general, suffixes such as "module" and "unit" may be used to refer to elements or components. Use of such suffixes herein is merely intended to facilitate description of the specification, and the suffixes do not have any special meaning or function. Accordingly, the "module" and "unit" may be used interchangeably.

In the present application, it should be understood that the terms "comprises, includes," "has," etc. specify the presence of features, numbers, steps, operations, elements, components, or combinations thereof described in the specification, but do not preclude the presence or addition of one or more other features, numbers, steps, operations, elements, components, or combinations thereof.

In addition, in this specification, terms such as first and second may be used to describe various elements, but these elements are not limited by these terms. These terms are only used to distinguish one element from another.

Figure 1:
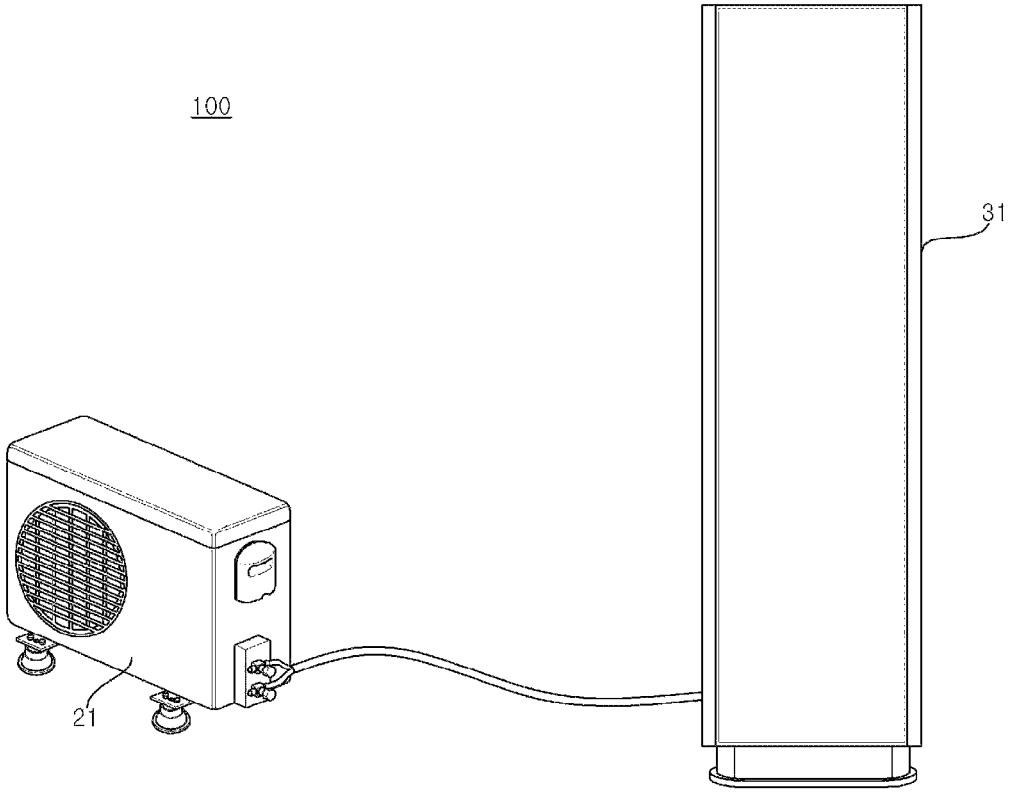
FIG. 1 is a diagram showing an example of a configuration of an air conditioner according to an embodiment of the present disclosure.

FIG. 1 is a diagram showing an example of a configuration of an air conditioner according to an embodiment of the present disclosure.

Referring to FIG. 1, an air conditioner 100 according to an embodiment of the present disclosure may include an outdoor unit 21, and an indoor unit 31 connected to the outdoor unit 21. As the indoor unit 31, any one of a stand-type air conditioner, a wall-mounted air conditioner, and a ceiling-type air conditioner can be applied, but the stand-type indoor unit 31 is exemplified in FIG. 1.

Meanwhile, the air conditioner 100 may further include at least one of a ventilator, an air purifier, a humidifier, and a heater, and may operate in association with the operation of the indoor unit 31 and the outdoor unit 21.

The outdoor unit 21 may include a compressor (not shown) that receives and compresses a refrigerant, an outdoor heat exchanger (not shown) that exchanges heat between the refrigerant and outdoor air, an accumulator (not shown) that extracts gaseous refrigerant from the supplied refrigerant and supplies it to the compressor, and a four-way valve (not shown) that selects a flow path of refrigerant according to heating operation. In addition, the outdoor unit 21 may further include a plurality of sensors, a valve, and an oil recovery device.

The outdoor unit 21 may supply refrigerant to the indoor unit 31 by operating the compressor and the outdoor heat exchanger to compress or heat exchange the refrigerant according to settings. The outdoor unit 21 may be driven by a remote controller (not shown) or a demand of the indoor unit 31. In this case, as the cooling/heating capacity is varied in response to the driven indoor units 31, the number of operating outdoor units and the number of operating compressors installed in the outdoor unit can also be varied.

At this time, the outdoor unit 21 may supply the compressed refrigerant to the connected indoor unit 31. The indoor unit 31 may receive the refrigerant from the outdoor unit 21 and discharge hot and cold air into the room. The indoor unit 31 may include an indoor heat exchanger (not shown), an indoor unit fan (not shown), an expansion valve (not shown) through which supplied refrigerant expands, and a plurality of sensors (not shown).

The indoor unit 31 may include a drain pan (not shown) that is disposed adjacent to the indoor heat exchanger to collect water generated by heat exchange of the indoor heat exchanger, and a drain pipe (not shown) that discharges the water collected in the drain pan to the outside.

At this time, the outdoor unit 21 and the indoor unit 31 may be connected by, for example, a communication line to transmit and receive data to each other, and the outdoor unit 21 and the indoor unit 31 may be connected with a remote controller (not shown) by wire or wirelessly, and operated under the control of a remote controller (not shown).

A remote control (not shown) may be connected to the indoor unit 31, transmit a user's control command to the indoor unit 31, and receive and display state information of the indoor unit 31. At this time, the remote control may communicate with the indoor unit 31 by wire or wirelessly depending on a connection type.

Figure 2:
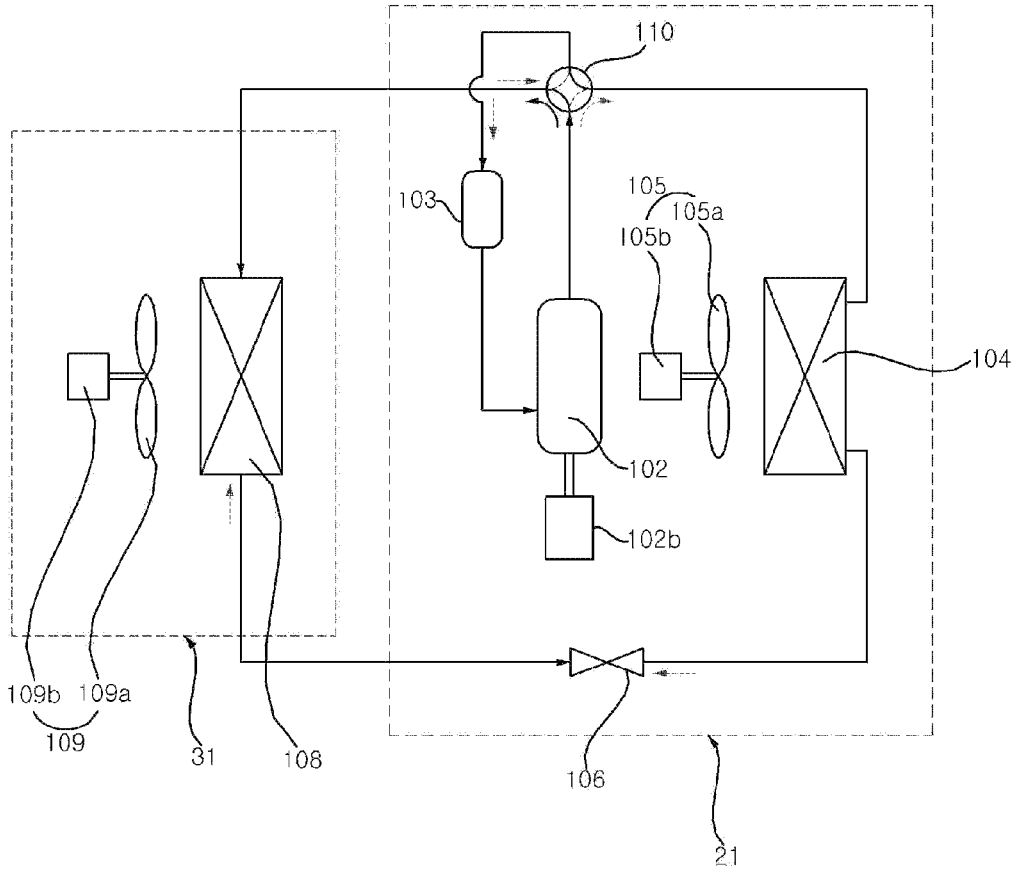
FIG. 2 is a schematic diagram of an outdoor unit and an indoor unit according to an embodiment of the present disclosure.

FIG. 2 is a schematic diagram of the outdoor unit and the indoor unit according to an embodiment of the present disclosure. Detailed descriptions of contents overlapping those described in FIG. 1 will be omitted.

Referring to FIG. 2, an outdoor unit 21 may include a compressor 102 that serves to compress the refrigerant, a compressor motor 102*b* that drives the compressor 102, an outdoor heat exchanger 104 that serves to dissipate heat from the compressed refrigerant, an outdoor blower 105 comprised of an outdoor fan 105*a* that is disposed in one side of the outdoor heat exchanger 104 to promote heat dissipation of the refrigerant and a motor 105*b* that rotates the outdoor fan 105*a*, an expansion valve 106 that expands the condensed refrigerant, a cooling/heating switching valve 110 that changes the flow path of the compressed refrigerant, and an accumulator 103 that temporarily stores the vaporized refrigerant to remove moisture and foreign substances and then supplies the refrigerant of constant pressure to the compressor.

The expansion valve 106 may be, for example, an electronic expansion valve EEV.

The indoor unit 31 may include an indoor heat exchanger 108 disposed indoors to perform a cooling/heating function, an indoor blower 109 composed of an indoor fan 109*a* disposed in one side of the indoor heat exchanger 108 to promote heat dissipation of the refrigerant and a motor 109*b* that rotates the indoor fan 109*a*, and the like.

At least one indoor heat exchanger 108 may be installed. The compressor 102 may be, for example, at least one of an inverter compressor and a constant speed compressor.

In addition, the air conditioner 100 may be configured of a cooler that cools the room, or configured of a heat pump that cools or heats the room.

Figure 3:
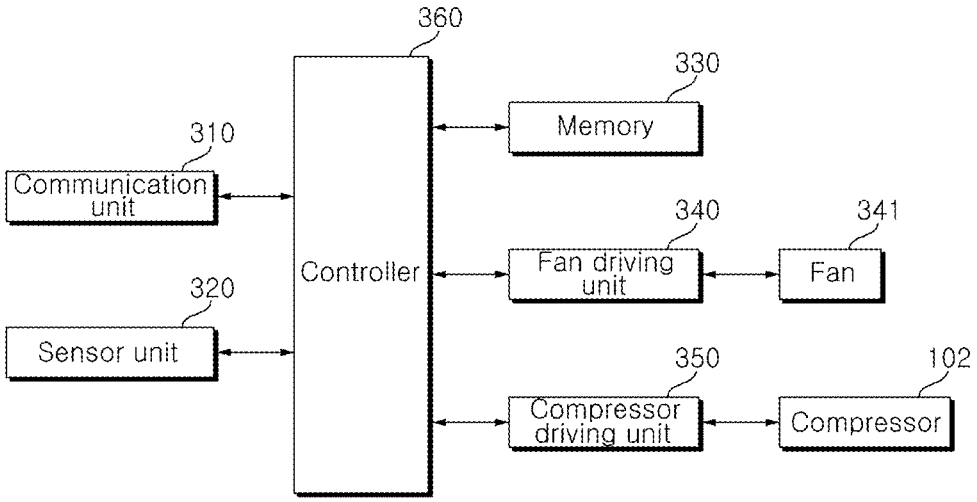
FIG. 3 is a block diagram of an air conditioner according to an embodiment of the present disclosure.

FIG. 3 is a block diagram of an air conditioner according to an embodiment of the present disclosure.

Referring to FIG. 3, the air conditioner 100 may include a communication unit 310, a sensor unit 320, a memory 330, a fan driving unit 340 for driving a fan 341, a compressor driving unit 350 for driving a compressor 102, and/or a controller 360.

The communication unit 310 may include at least one communication module. For example, the communication unit 310 may be provided in each of the outdoor unit 21 and the indoor unit 31, and the outdoor unit 21 and the indoor unit 31 may transmit and receive data to each other.

The communication method between the outdoor unit 21 and the indoor unit 31 may be, for example, a communication method using a power line, a serial communication method (e.g. RS-485 communication), a wired communication method through a refrigerant pipe, as well as a wireless communication method such as Wi-Fi, Bluetooth, Beacon, and zigbee.

The communication unit 310 may transmit/receive data with an external device. For example, the communication unit 310 may transmit/receive data by accessing a server connected to an external network.

The sensor unit 320 may include at least one sensor, and may transmit data related to a detection value detected through the sensor to the controller 360.

The sensor unit 320 may include a heat exchanger temperature sensor (not shown). For example, the heat exchanger temperature sensor may be disposed inside the indoor heat exchanger 108 to detect the temperature of the indoor heat exchanger 108.

The sensor unit 320 may include a pipe temperature sensor (not shown). The pipe temperature sensor may detect the temperature of the refrigerant flowing through each pipe of the air conditioner 100. For example, the pipe temperature sensor may be disposed in an inlet pipe of the indoor unit 31 and/or an outlet pipe of the indoor unit 31, and may detect the temperature of the refrigerant flowing through the pipe. For example, the pipe temperature sensor may be disposed in a pipe connected to the compressor 102, and may detect the temperature (hereinafter, suction temperature) of the refrigerant flowing into the compressor 102 and/or the temperature (hereinafter, discharge temperature) of the refrigerant discharged from the compressor 102.

The sensor unit 310 may include a pressure sensor (not shown).

The pressure sensor (not shown) may detect the pressure of the gaseous refrigerant flowing through each pipe of the air conditioner 100.

For example, the pressure sensor may be disposed in a pipe connected to the compressor 102, and may detect the pressure (hereinafter, suction pressure) of the refrigerant flowing into the compressor 102 and/or the pressure (hereinafter, discharge pressure) of the refrigerant discharged from the compressor 102.

The sensor unit 320 may include an indoor temperature sensor (not shown) that detects indoor temperature and/or an outdoor temperature sensor (not shown) that detects outdoor temperature.

The sensor unit 320 may include an indoor humidity sensor (not shown) that detects indoor humidity and/or an outdoor humidity sensor (not shown) that detects outdoor humidity.

The memory 330 may store the data of reference value related to the operation of each component provided in the air conditioner 100.

The memory 330 may store programs for processing and controlling each signal in the controller 360, and may store a processed data and a processing target data.

For example, the memory 330 may store application programs designed for the purpose of performing various tasks processable by the controller 360, and upon request of the controller 360, may selectively provide some of the stored application programs.

The memory 330 may include at least one of, for example, volatile memory (e.g. DRAM, SRAM, SDRAM, etc.) and non-volatile memory (e.g. flash memory, hard disk drive (HDD), solid state-state drive (SSD), etc.).

The fan driving unit 340 may drive the fan 341 provided in the air conditioner 100. For example, the fan 341 may include an outdoor fan 105*a* and/or an indoor fan 109*a*.

The fan driving unit 340 may include a rectifier (not shown) that rectifies AC power into DC power and outputs, a DC terminal capacitor (not shown) that stores a ripple voltage from the rectifier, an inverter (not shown) which is equipped with a plurality of switching elements, and converts and outputs smoothed DC power to 3-phase AC power of a certain frequency, and/or at least one motor that drives the fan 341 according to a 3-phase AC power output from the inverter.

Meanwhile, the fan driving unit 340 may have separate components for driving the outdoor fan 105*a* and the indoor fan 109*a*. For example, the air conditioner 100 may include a first fan driving unit for driving the outdoor fan 105*a* and a second fan driving unit for driving the indoor fan 109*a*.

The compressor driving unit 350 may drive the compressor 102. The compressor driving unit 350 may include a rectifier (not shown) that rectifies AC power into DC power and outputs, a DC terminal capacitor (not shown) that stores a ripple voltage from the rectifier, an inverter (not shown) which is equipped with a plurality of switching elements, and converts and outputs smoothed DC power to 3-phase AC power of a certain frequency, and/or a compressor motor 102*b* that drives the compressor 102 according to a three-phase AC power output from the inverter.

The controller 360 may control overall operations of the air conditioner 100. The controller 360 may be connected to each component provided in the air conditioner 100, and may transmit and/or receive signals to/from each component and control the overall operation of each component.

The controller 360 may control the operation of the fan driving unit 340 to change the number of revolutions of the fan 341. For example, the fan driving unit 340 may change the number of revolutions of the outdoor fan 105*a*, by changing the frequency of the three-phase AC power output to the outdoor fan motor 105*b*, under the control of the controller 360. For example, the fan driving unit 340 may change the number of revolutions of the indoor fan 109*a*, by changing the frequency of the three-phase AC power output to the indoor fan motor 109*b*, under the control of the controller 360.

The controller 360 may change the operating frequency of the compressor 102 by controlling the operation of the compressor driving unit 350. For example, the compressor driving unit 350 may change the operating frequency of the compressor 102 by changing the frequency of the three-phase AC power output to the compressor motor 102*b* under the control of the controller 360.

The controller 360 may be provided not only in the outdoor unit 21, but also in the indoor unit 31, a central controller (not shown) that controls the operation of the outdoor unit 21 and/or the indoor unit 31, and the like.

The controller 360 may include at least one processor, and may control the overall operation of the air conditioner 100 by using the processor. Here, the processor may be a general processor such as a central processing unit CPU. Obviously, the processor may be a dedicated device such as an ASIC or other hardware-based processor.

The controller 360 may obtain data related to each component provided in the air conditioner 100. At this time, the controller 360 may obtain data related to each component provided in the air conditioner 100 at regular time intervals, according to a certain period in consideration of the computational load.

The controller 360 may perform various calculations based on the obtained data, and may control overall operations of each component provided in the air conditioner 100 according to the calculation results.

Data related to each component provided in the air conditioner 100 may include, for example, the operating frequency of the compressor 102, the suction temperature of the compressor 102, the discharge temperature, the suction pressure, the discharge pressure, the inlet pipe temperature of the indoor unit 31, the outlet pipe temperature of the indoor unit 31, the indoor temperature, the outdoor temperature, the opening degree of the electronic expansion valve (EEV), and the like.

Meanwhile, the air conditioner 100 may further include an input device (not shown) capable of receiving a user input. For example, when a user input is received through an input device (e.g. a touch panel, a key, etc.), the air conditioner 100 may perform an operation corresponding to the user input.

The air conditioner 100 may further include an output device (not shown) outputting a message about an operating state of the air conditioner 100. For example, the output device may include a display device such as a display and a light emitting diode (LED) and/or an audio device such as a speaker and a buzzer.

Figure 4:
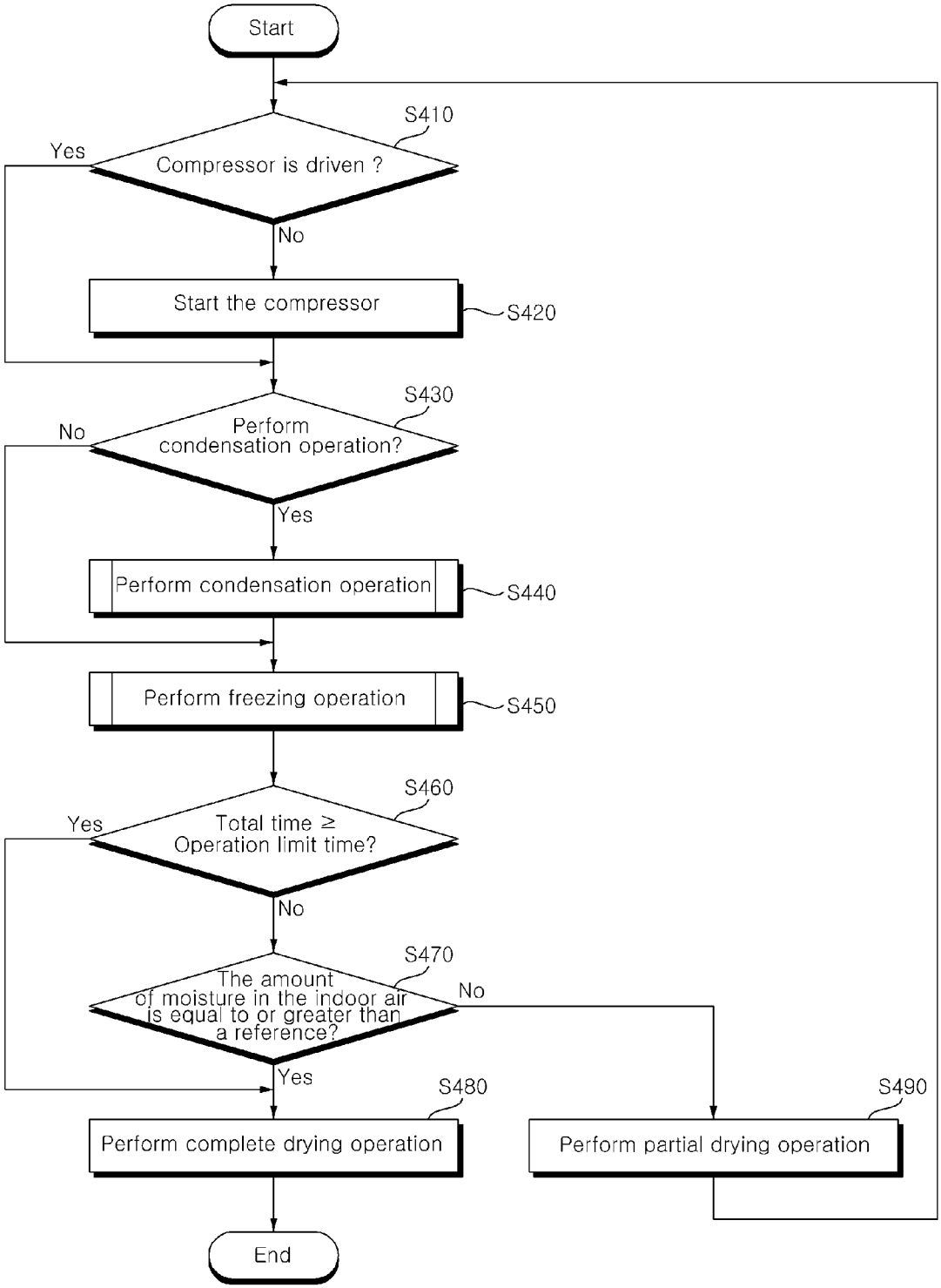
FIG. 4 is a flowchart illustrating an operating method of an air conditioner according to an embodiment of the present disclosure.

FIG. 4 is a flowchart illustrating an operating method of an air conditioner according to an embodiment of the present disclosure, and FIGS. 5 to 13 are diagrams for explaining the operation of the air conditioner of FIG. 4.

Referring to FIG. 4, the air conditioner 100 may check whether the compressor 102 is driven at operations S410 and S420, and control the compressor driving unit 350 to start the compressor 102, when the compressor 102 is not driven.

The air conditioner 100 may determine that the compressor 102 is driven and the refrigerant cycle is stabilized, when the compressor 102 can sufficiently compress the introduced refrigerant into a high-temperature, high-pressure gaseous refrigerant according to the purpose. For example, the air conditioner 100 may check whether the compressor 102 is driven, based on the operating frequency, suction temperature, discharge temperature, suction pressure, discharge pressure, and the like of the compressor 102.

Meanwhile, when starting the compressor 102, the air conditioner 100 may control the operation of each component according to preset conditions so that the operating frequency of the compressor 102 reaches a certain frequency. For example, when starting the compressor 102, the air conditioner 100 may open the electronic expansion valve (EEV) according to a preset opening degree.

At this time, the air conditioner 100 may control the operation of each component according to the cooling mode for cooling the room.

At operation S430, when the compressor 102 is driven, the air conditioner 100 may determine whether to perform an operation (hereinafter, a condensation operation) related to condensation of moisture contained in indoor air. Here, the condensation operation may refer to an operation of the air conditioner 100 that causes moisture contained in indoor air to form water droplets on the surface of the indoor heat exchanger 108.

For example, the air conditioner 100 may be preset to perform a condensation operation, when performing an operation for removing foreign substances.

For example, the air conditioner 100 may output a message about the performance of the condensation operation through the output device, and may determine whether to perform the condensation operation in response to a user input received through the input device. At this time, when there is a history of previously receiving user input related to the performance of the condensation operation, the air conditioner 100 may not output a message about the performance of the condensation operation through the output device, and determine whether to perform the condensation operation according to a previously received user input. Meanwhile, when not performing the condensation operation, the air conditioner 100 branches to operation S450 to perform an operation (hereinafter, a freezing operation) related to freezing of moisture. Here, the freezing operation may refer to an operation of the air conditioner 100 to form ice on the surface of the indoor heat exchanger 108.

The air conditioner 100 may perform a condensation operation, at operation S440. Hereinafter, the condensation operation will be described in detail with reference to FIG. 5.

Figure 5:
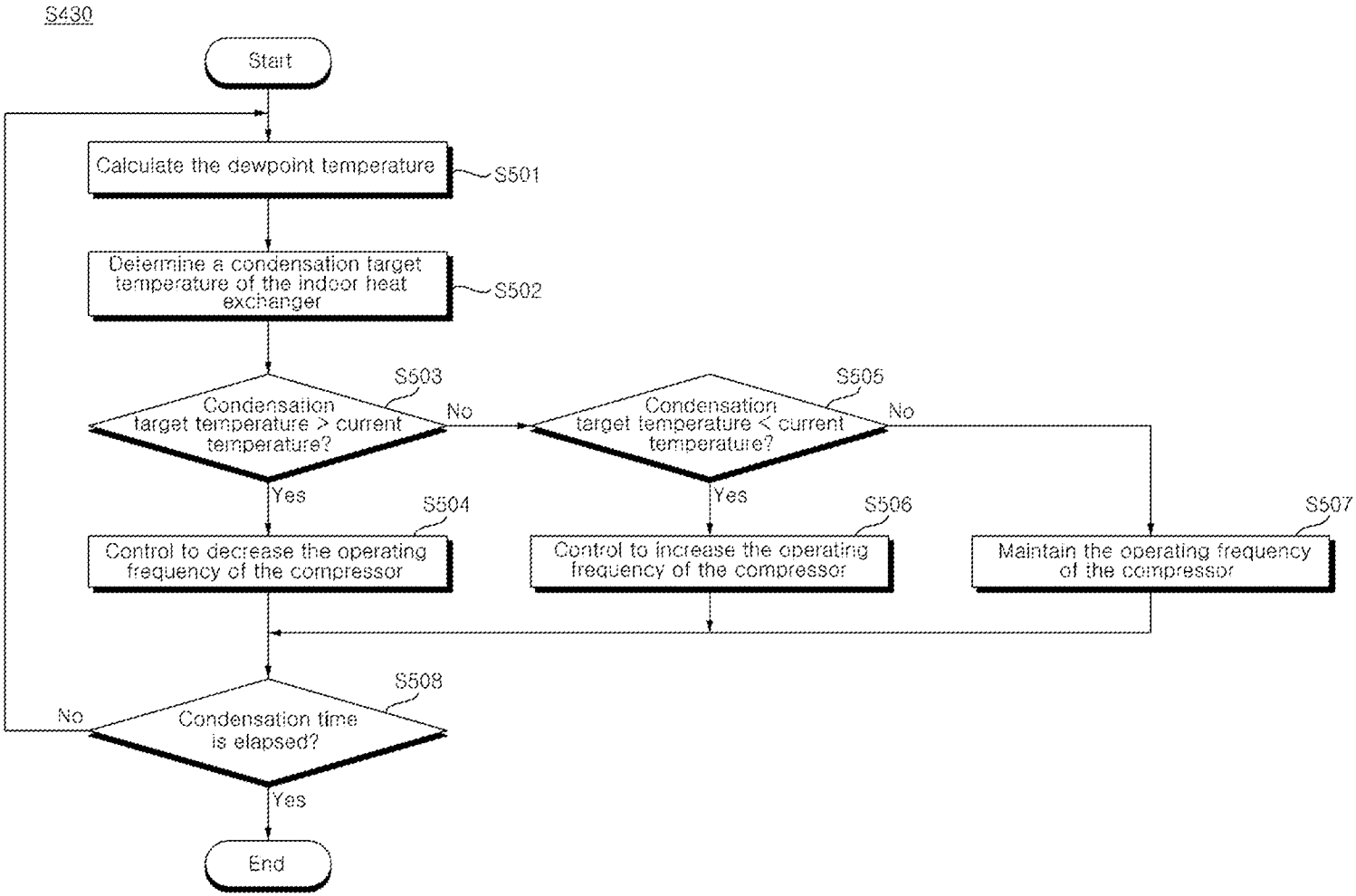
FIGS. 5 to 13 are diagrams for explaining the operation of the air conditioner of FIG. 4.

Referring to FIG. 5, the air conditioner 100 may calculate the dewpoint temperature of indoor air, through at least one sensor included in the sensor unit 320, at operation S501.

Figure 6:
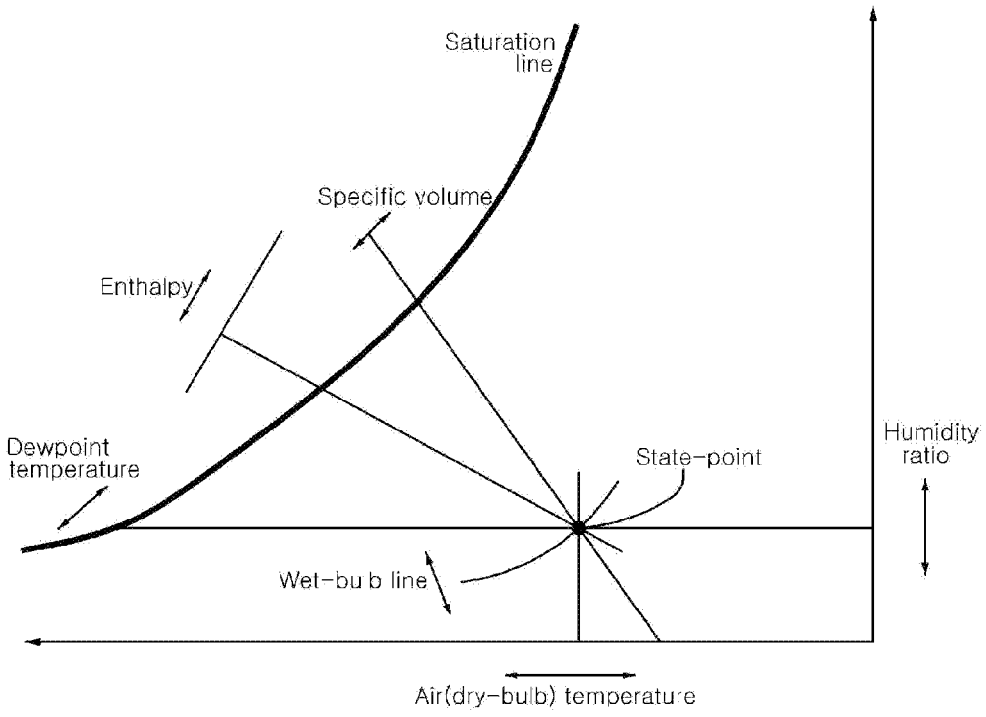

Referring to FIG. 6, when a state point corresponding to the dry-bulb temperature and relative humidity of indoor air is determined on a psychrometric chart, the dew point temperature, wet-bulb temperature, enthalpy, specific volume, and the like corresponding to the state point may be determined.

For example, the air conditioner 100 may receive data on the dry-bulb temperature and relative humidity of the indoor air from the indoor temperature sensor and the indoor humidity sensor, and may calculate the dew point temperature of indoor air by using a formula based on the psychrometric chart.

The air conditioner 100 may determine a target temperature for the temperature of the indoor heat exchanger 108 based on the calculated dew point temperature, at operation S502. In this case, the target temperature in the condensation operation may be referred to as a condensation target temperature.

For example, the air conditioner 100 may determine a temperature lower than the dew point temperature of indoor air by a certain temperature as the condensation target temperature. At this time, the certain temperature may be a temperature difference (e.g., 2° C.) at a level where moisture contained in the indoor air is formed as water droplets on the surface of the indoor heat exchanger 108 and freezing of the water droplets does not occur.

Meanwhile, the air conditioner 100 may determine a limit temperature (e.g., 5° C.) as the condensation target temperature, when a temperature lower than the dew point temperature by a certain temperature is equal to or less than a preset limit temperature (e.g., 5° C.).

The air conditioner 100 may check the current temperature of the indoor heat exchanger 108, and may check whether the current temperature of the indoor heat exchanger 108 is less than the condensation target temperature, based on the data received from the sensor unit 320, at operation S503. For example, the air conditioner 100 may calculate the current temperature of the indoor heat exchanger 108, based on the lower temperature value among the inlet pipe temperature of the indoor unit 31 and the outlet pipe temperature of the indoor unit 31 detected by at least one pipe temperature sensor. For example, the air conditioner 100 may check the current temperature of the indoor heat exchanger 108, based on the temperature detected through the heat exchanger temperature sensor.

The air conditioner 100 may control the compressor driving unit 350 to decrease the operating frequency of the compressor 102, when the current temperature of the indoor heat exchanger 108 is less than the condensation target temperature, at operation S504.

Meanwhile, the air conditioner 100 may check whether the current temperature of the indoor heat exchanger 108 exceeds the condensation target temperature, when the current temperature of the indoor heat exchanger 108 is not less than the condensation target temperature, at operation S505.

The air conditioner 100 may control the compressor driving unit 350 to increase the operating frequency of the compressor 102, when the current temperature of the indoor heat exchanger 108 exceeds the condensation target temperature, at operation S506.

Meanwhile, at operation S507, the air conditioner 100 may control the compressor driving unit 350 to maintain the operating frequency of the compressor 102, when the current temperature of the indoor heat exchanger 108 corresponds to the condensation target temperature.

The air conditioner 100 may check whether a first preset time (hereinafter, condensation time) has elapsed from the time of starting the condensation operation, at operation S508. In this case, when the preset condensation time has not elapsed, the air conditioner 100 may branch to operation S501 to adjust the operating frequency of the compressor 102 according to the dew point temperature of the indoor air.

Figure 7:
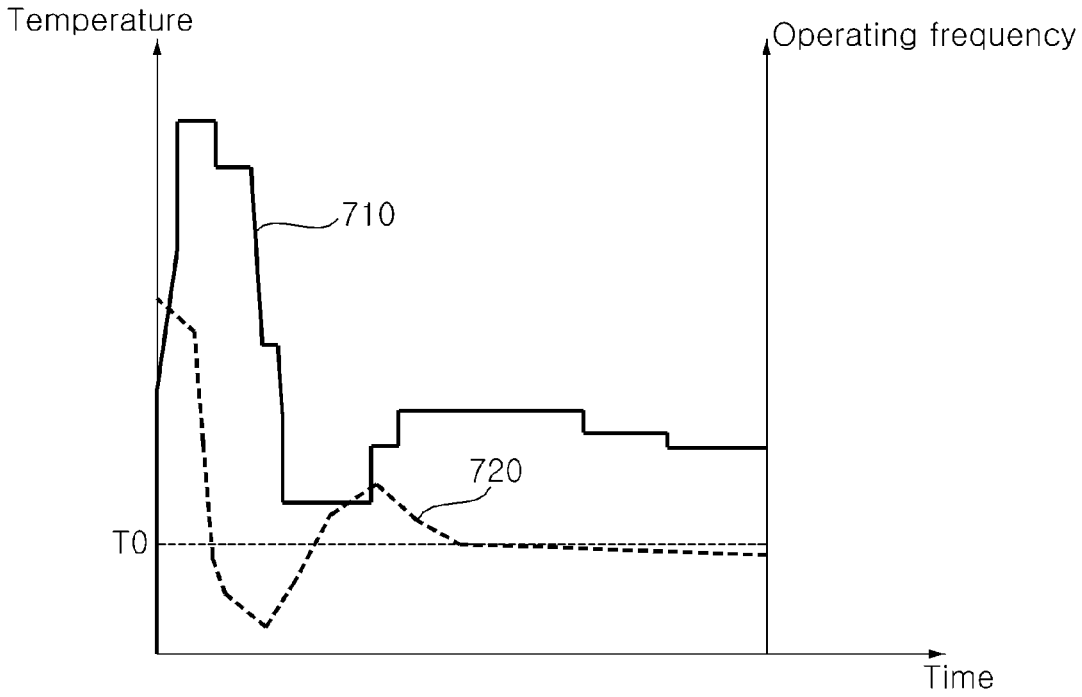

FIG. 7 is a diagram illustrating a graph 710 of the operating frequency of the compressor 102 and a graph 720 of the temperature of the inlet pipe of the indoor unit 31.

Referring to FIG. 7, when the air conditioner 100 increases the operating frequency of the compressor 102, the temperature of the inlet pipe of the indoor unit 31 decreases, and as a result, the temperature of the indoor heat exchanger 108 decreases.

In addition, when the temperature of the indoor heat exchanger 108 approaches the condensation target temperature TO, it can be checked that the operating frequency of the compressor 102 is maintained constant.

Referring back to FIG. 4, the air conditioner 100 may perform a freezing operation when the condensation operation is completed, at operation S450. Hereinafter, the freezing operation will be described in detail with reference to FIGS. 8A to 8C.

Figure 8A:
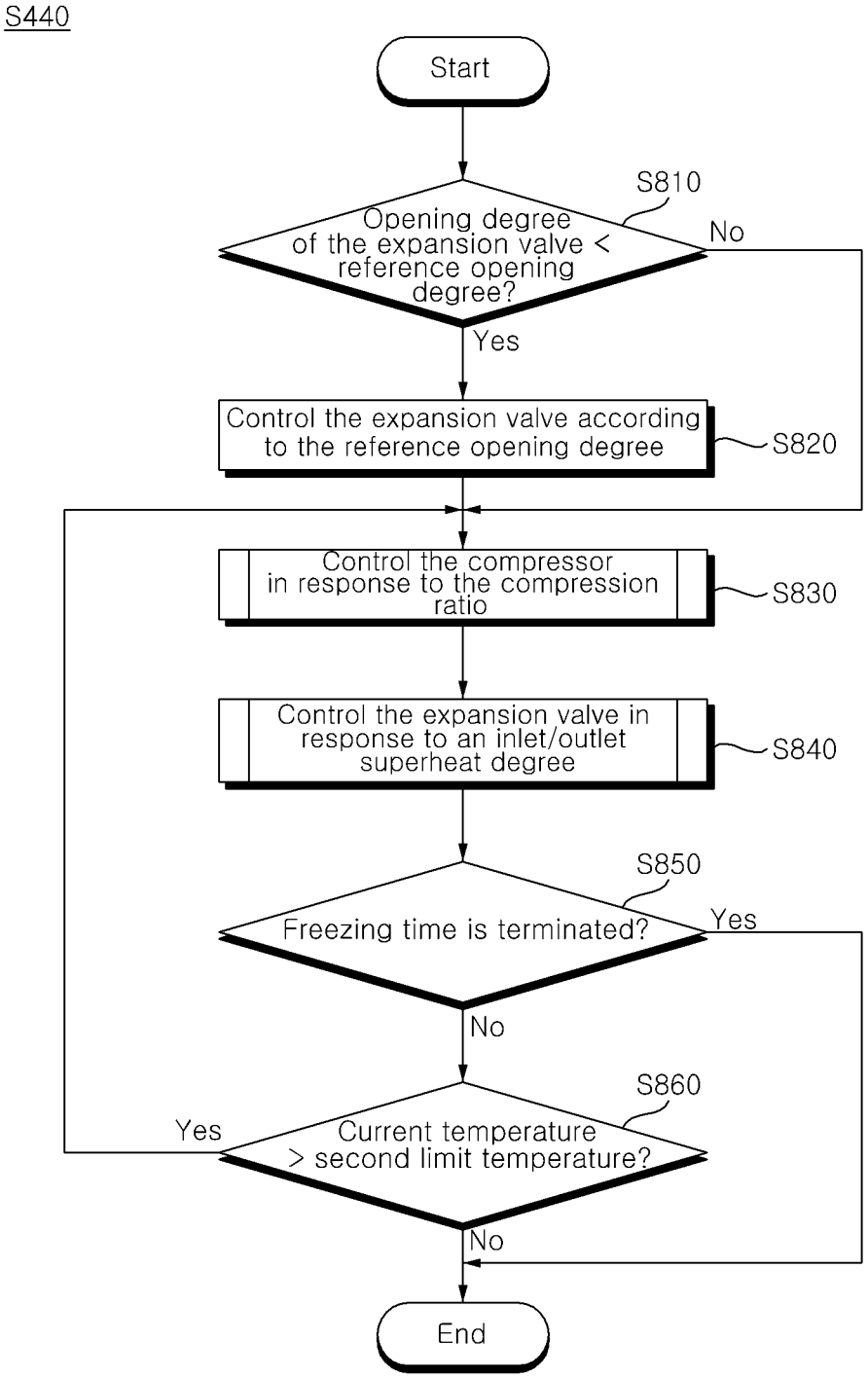

Referring to FIG. 8A, the air conditioner 100 may check whether the opening degree of the expansion valve 106 is less than a preset reference opening degree, at operation S810. Here, the reference opening degree may correspond to the opening degree of the expansion valve 106 at the time when the starting of the compressor 102 is completed.

Figure 9:
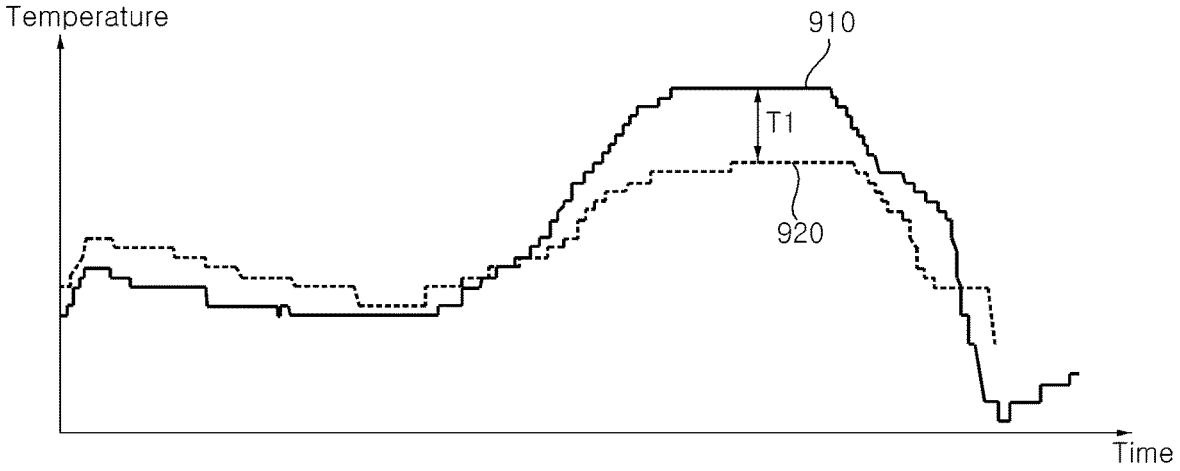

FIG. 9 is diagram illustrating a graph of a change in the discharge temperature of the compressor 102, when the freezing operation is performed.

Referring to FIG. 9, a graph 910 of the change in discharge temperature when the opening degree of the expansion valve 106 is less than the reference opening degree, and a graph 920 of the change in discharge temperature when the opening degree of the expansion valve 106 is greater than or equal to the reference opening degree may be checked.

At this time, when the air conditioner 100 performs the freezing operation in a state where the opening degree of the expansion valve 106 is less than the reference opening degree, in comparison with the case where the expansion valve 106 is sufficiently open, the discharge temperature of the compressor 102 may be increased as much as the T1 temperature difference.

If the discharge temperature of the compressor 102 is excessively high, the compression ratio of the compressor 102 may also increase. Therefore, the air conditioner 100 may perform control such as stopping the operation of the compressor 102 to prevent damage to the compressor 102.

Thus, it is difficult for the refrigerant to be sufficiently compressed in the compressor 102. Therefore, freezing of moisture condensed in the indoor heat exchanger 108 may be difficult to occur.

Referring back to FIG. 8A, when the opening degree of the expansion valve 106 is less than the preset reference opening degree, the air conditioner 100 may control to increase the opening degree of the expansion valve 106 according to the reference opening degree, at operation S820. For example, the air conditioner 100 may open the expansion valve 106 so that the opening degree of the expansion valve 106 reaches the reference opening degree.

The air conditioner 100 may control the operation of the compressor 102, in response to the compression ratio according to the discharge pressure and the suction pressure of the compressor 102, at operation S830. In this regard, it will be described in detail with reference to FIG. 8B.

Figure 8B:
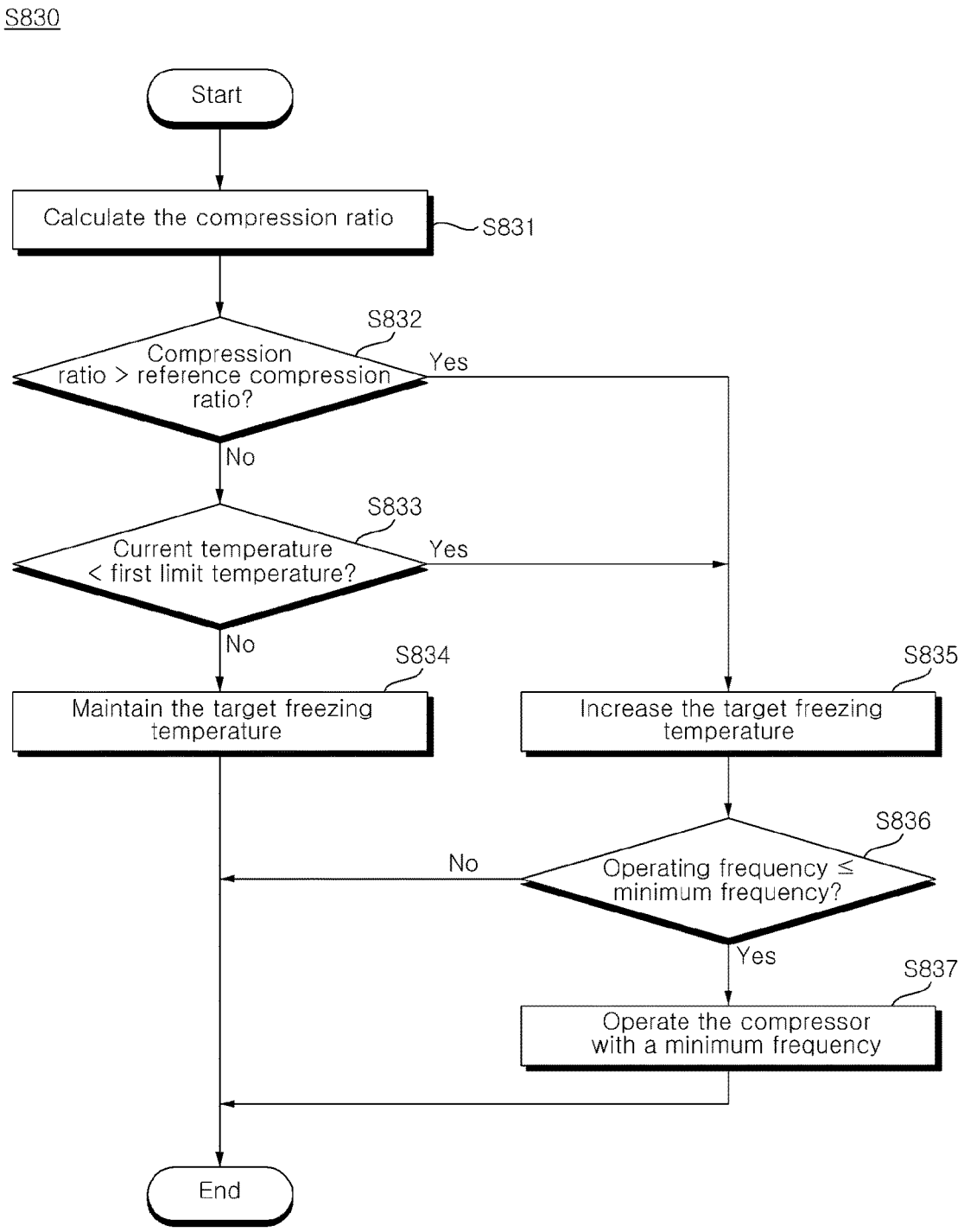

Referring to FIG. 8B, the air conditioner 100 may calculate the compression ratio of the compressor 102 at operation S831. Here, the compression ratio may mean a ratio of discharge pressure to suction pressure.

Meanwhile, the air conditioner 100 may calculate the compression ratio of the compressor 102, based on the temperature of the outdoor heat exchanger 104 and the temperature of the indoor heat exchanger 108. For example, the air conditioner 100 may calculate the compression ratio of the compressor 102 by converting, among the temperature of the outdoor heat exchanger 104 and the temperature of the indoor heat exchanger 108, the higher temperature into the discharge pressure, and the lower temperature into the suction pressure.

The air conditioner 100 may check whether the compression ratio of the compressor 102 exceeds a preset reference compression ratio, at operation S832. Here, the reference compression ratio may mean a maximum value of a compression ratio that is reliable without damaging the compressor 102.

At operation S833, when the compression ratio of the compressor 102 is equal to or less than the reference compression ratio, the air conditioner 100 may determine whether the current temperature of the indoor heat exchanger 108 is lower than a certain first limit temperature, based on the data received from the sensor unit 320. Here, the first limit temperature may mean a preset temperature (e.g., −17° C.) at which freezing of moisture condensed in the indoor heat exchanger 108 sufficiently occurs at a certain level or more.

Meanwhile, the first limit temperature may be a temperature lower than a target temperature for the temperature of the indoor heat exchanger 108 during the freezing operation. In this case, the target temperature during the freezing operation may be referred to as a target freezing temperature. For example, the air conditioner 100 may determine the target freezing temperature within a temperature ranging from a certain temperature (e.g., −15° C.) higher than the first limit temperature (e.g., −17° C.) or higher, to 0° C. or lower.

The air conditioner 100 may maintain the target freezing temperature, when the current temperature of the indoor heat exchanger 108 is equal to or higher than the first limit temperature, at operation S834.

At this time, the air conditioner 100 may control the operating frequency of the compressor 102, based on the difference between the current temperature of the indoor heat exchanger 108 and the target freezing temperature. For example, the air conditioner 100 may control the compressor driving unit 350 to increase the operating frequency of the compressor 102, when the current temperature of the indoor heat exchanger 108 is higher than the target freezing temperature.

Meanwhile, when the compression ratio of the compressor 102 exceeds the reference compression ratio, or when the current temperature of the indoor heat exchanger 108 is lower than the first limit temperature, the air conditioner 100 may increase the currently set target freezing temperature, at operation S835. At this time, the air conditioner 100 may increase the currently set target freezing temperature by a preset temperature.

The air conditioner 100 may check whether the operating frequency of the compressor 102 determined in response to the increased target freezing temperature is equal to or less than a preset minimum frequency, at operation S836. Here, the minimum frequency may correspond to a minimum value (e.g., 65 Hz) of the operating frequency of the compressor 102 at which freezing of moisture condensed in the indoor heat exchanger 108 may occur.

When the operating frequency of the compressor 102 determined in response to the increased freezing target temperature is equal to or less than the minimum frequency, the air conditioner 100 may set the minimum frequency as the operating frequency of the compressor 102 to control the operation of the compressor 102, at operation S837.

Meanwhile, the air conditioner 100 may control the operating frequency of the compressor 102 according to the increased target freezing temperature, when the operating frequency of the compressor 102 determined in response to the increased target freezing temperature is higher than the minimum frequency.

Figure 10:
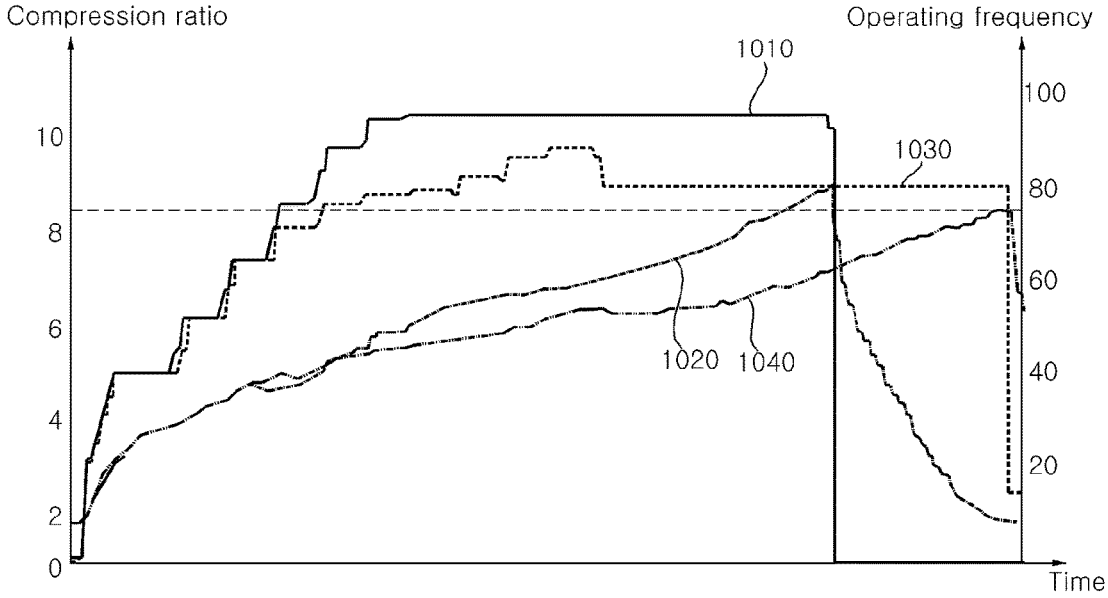

FIG. 10 is a diagram showing a graph 1010 for the operating frequency and a graph 1020 for the compression ratio in the case where the compression ratio is not considered, and a graph 1030 for the operating frequency and a graph 1040 for the compression ratio in the case where the compression ratio is considered.

Referring to FIG. 10, when the compression ratio is not considered, the operating frequency of the compressor 102 may be maintained at a high value according to the target freezing temperature during the freezing operation, and the freezing of moisture condensed in the indoor heat exchanger 108 may continue. At this time, as freezing of moisture progresses, the suction pressure of the compressor 102 may gradually decrease, and thus, the compression ratio of the compressor 102 may exceed the reference compression ratio (e.g., 8.3).

When the compression ratio of the compressor 102 exceeds the reference compression ratio (e.g., 8.3), the air conditioner 100 may stop the operation of the compressor 102 to prevent damage to the compressor 102.

Meanwhile, even when the compression ratio is considered, the operating frequency of the compressor 102 during the freezing operation may be adjusted according to the target freezing temperature. At this time, when the compression ratio of the compressor 102 reaches the reference compression ratio (e.g., 8.3), the air conditioner 100 may increase the target freezing temperature, and in response to the increased target freezing temperature, may adjust the operating frequency of the compressor 102.

As a result, due to the control of the air conditioner 100 in consideration of the compression ratio, the freezing of moisture may progress while the compression ratio of the compressor 102 is lower than the reference compression ratio (e.g., 8.3).

Referring back to FIG. 8A, the air conditioner 100 may control the expansion valve 106 in response to an inlet/outlet superheat degree according to the inlet pipe temperature and the outlet pipe temperature of the indoor unit 31, at operation S840. In this regard, it will be described in detail with reference to FIG. 8C.

Figure 8C:
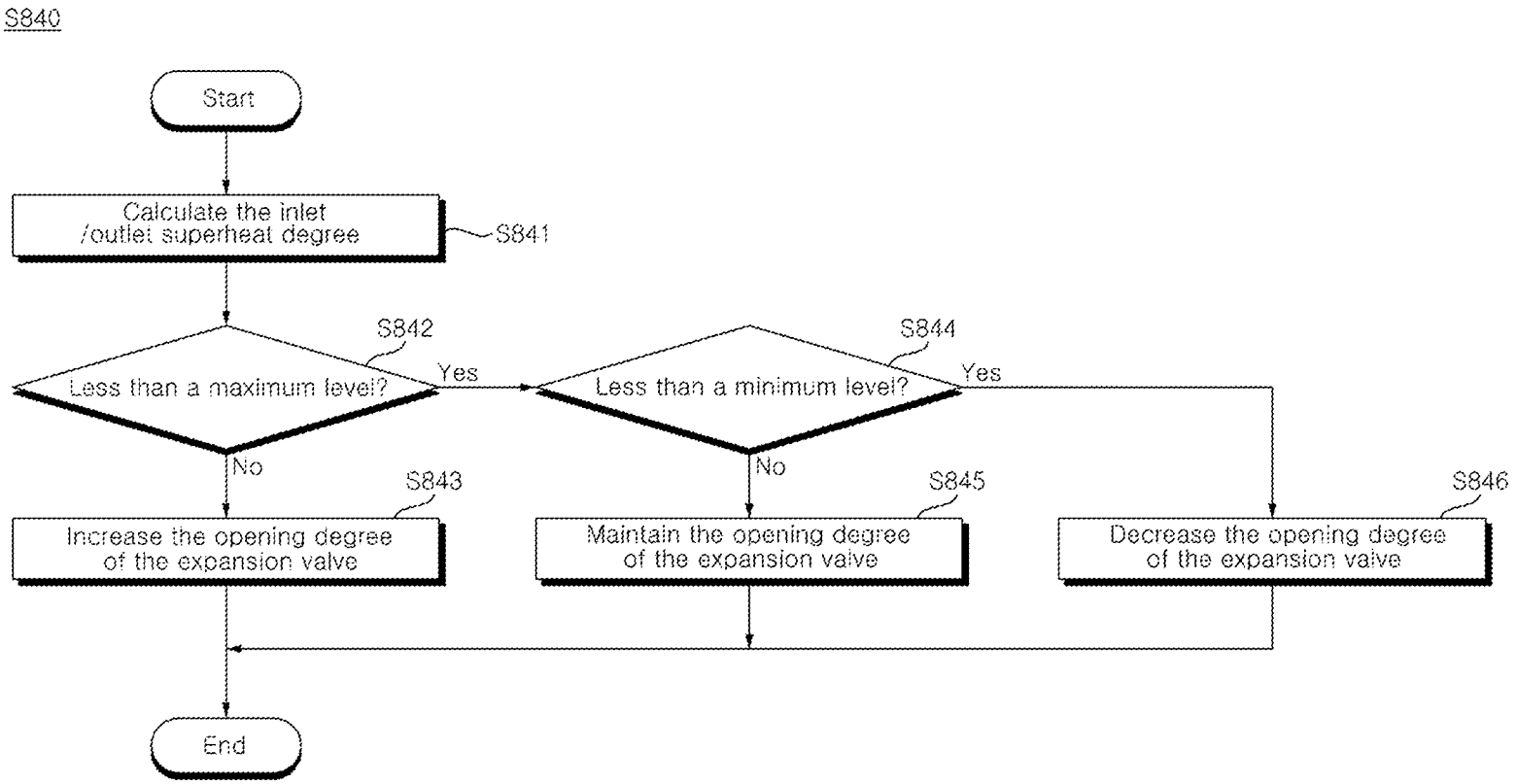

Referring to FIG. 8C, the air conditioner 100 may calculate the inlet/outlet superheat degree through at least one pipe temperature sensor, at operation S841. Here, the inlet/outlet superheat degree may correspond to a value obtained by subtracting the inlet pipe temperature from the outlet pipe temperature of the indoor unit 31.

The air conditioner 100 may determine whether the inlet/outlet superheat degree is less than a preset maximum level, at operation S842.

When the inlet/outlet superheat degree is higher than the maximum level, that is, when the outlet pipe temperature of the indoor unit 31 is higher than the inlet pipe temperature by a certain level or more, among the entire area of the indoor heat exchanger 108, freezing of moisture can occur more easily in an area adjacent to the inlet side of the indoor unit 31 than in an area adjacent to the outlet side of the indoor unit 31.

In this case, since moisture is not uniformly frozen in the entire area of the indoor heat exchanger 108, foreign substances may not be properly removed from some area of the indoor heat exchanger 108.

The air conditioner 100 may control the opening degree of the expansion valve 106 to increase, when the inlet/outlet superheat degree is equal to or greater than the maximum level, at operation S843. At this time, as the opening degree of the expansion valve 106 increases, the inlet/outlet superheat degree may be lowered.

Meanwhile, the air conditioner 100 may determine whether the inlet/outlet superheat degree is less than a preset minimum level, at operation S844.

At operation S845, when the inlet/outlet superheat degree is less than the maximum level, and greater than or equal to the minimum level, that is, when the difference between the outlet pipe temperature and the inlet pipe temperature of the indoor unit 31 is within a certain level, the air conditioner 100 may maintain the opening degree of the expansion valve 106.

At operation S846, when the inlet/outlet superheat degree is less than the minimum level, that is, when the outlet pipe temperature of the indoor unit 31 is lower than the inlet pipe temperature by a certain level or more, the air conditioner 100 may control the opening degree of the expansion valve 106 to decrease.

For example, as the freezing of moisture progresses, the outlet pipe temperature of the indoor unit 31 and the suction pressure of the compressor 102 may gradually decrease, and correspondingly, the compression ratio of the compressor 102 may gradually increase. At this time, the air conditioner 100 may control the opening degree of the expansion valve 106 to decrease so that moisture is uniformly frozen in the entire area of the indoor heat exchanger 108 and damage to the compressor 102 is prevented. Accordingly, the inlet pipe temperature of the indoor unit 31 may increase.

Figure 11:
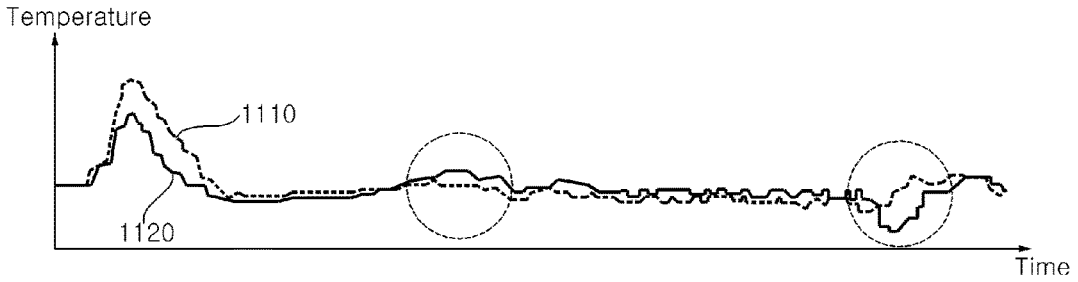

FIG. 11 is a graph showing a change in the inlet/outlet superheat degree according to the opening degree of the expansion valve 106.

Referring to FIG. 11, a graph 1110 when the opening degree of the expansion valve 106 is adjusted in response to a change in the inlet/outlet superheat degree, and a graph 1120 when the opening degree of the expansion valve 106 is fixed may be compared.

Based on the two graphs 1110 and 1120, when the opening degree of the expansion valve 106 is adjusted in response to the change in the inlet/outlet superheat degree, in comparison with the case where the opening degree of the expansion valve 106 is fixed, it can be seen that the change in the inlet/outlet superheat degree is small, which can be understood as higher stability of the refrigerant cycle.

Referring back to FIG. 8A, the air conditioner 100 may check whether a preset second time (hereinafter, freezing time) is elapsed from the time of starting the freezing operation, at operation S850.

The air conditioner 100 may check whether the current temperature of the indoor heat exchanger 108 is equal to or less than a certain second limit temperature, when the freezing time is not elapsed, at operation S860. Here, the second limit temperature may mean a temperature (e.g., −20° C.), which is lower than the first limit temperature (e.g., −17° C.), at which the temperature of the indoor heat exchanger 108 is excessively lowered due to an excessively high discharge temperature, or the like.

When the freezing time is not elapsed and the current temperature of the indoor heat exchanger 108 exceeds the certain second limit temperature, the air conditioner 100 branches to operation S830 to continue performing the freezing operation.

Meanwhile, the air conditioner 100 may control the fan driving unit 340 to adjust the rotational speed of the outdoor fan 105*a* and/or the indoor fan 109*a*, while performing the condensation operation and/or the freezing operation.

The air conditioner 100 may control the fan driving unit 340 so that the rotational speed of the indoor fan 109*a* is maintained constant during the condensation operation and/or the freezing operation. In this case, the rotational speed of the indoor fan 109*a* in the condensation operation and/or the freezing operation may be equal to or less than the minimum rotational speed of the indoor fan 109*a* in the cooling mode in which the air conditioner 100 cools the room.

The air conditioner 100 may control the fan driving unit 340 to change the rotational speed of the indoor fan 109*a* according to certain conditions, during the freezing operation.

For example, after a certain time (e.g., 12 minutes) elapses from the time when the freezing operation starts, when the inlet pipe temperature of the indoor unit 31 is equal to or higher than a preset upper limit temperature, the air conditioner 100 may control the fan driving unit 340 so that the rotational speed of the indoor fan 109*a* is lower than the current rotational speed.

Here, the preset upper limit temperature may be a temperature (e.g., −5° C.) corresponding to the highest temperature in a temperature range in which freezing of moisture condensed in the indoor heat exchanger 108 may occur.

For example, while performing the freezing operation, the air conditioner 100 may monitor the inlet pipe temperature of the indoor unit 31 according to a certain cycle (e.g., 100 seconds).

At this time, when the difference between the inlet pipe temperatures of the indoor unit 31 detected according to a certain cycle is less than a preset difference (e.g., 0.2° C.), the fan driving unit 340 may be controlled so that the rotational speed of the indoor fan 109*a* is lower than the current rotational speed.

Identically/similarly to controlling the rotational speed of the outdoor fan 105*a* in the cooling mode for cooling the room, the air conditioner 100 may control the rotational speed of the outdoor fan 105*a* according to the operating frequency of the compressor 102, the outdoor temperature, and the like, in the condensation operation and/or the freezing operation.

At this time, the air conditioner 100 may control the fan driving unit 340 so that the rotational speed of the outdoor fan 105*a* maintains a preset maximum speed, during the freezing operation.

Referring back to FIG. 4, at operation S460, when the freezing operation is completed, the air conditioner 100 may determine whether the total time elapsed from the initial start time of the condensation operation is greater than or equal to a preset third time (hereinafter, operation limit time).

At operation S470, the air conditioner 100 may determine whether the amount of moisture contained in the indoor air is equal to or greater than a preset reference, when the total time is less than the operation limit time.

For example, the air conditioner 100 may receive data on the dry bulb temperature and relative humidity of indoor air from an indoor temperature sensor and an indoor humidity sensor. At this time, the air conditioner 100 may calculate at least one of the wet bulb temperature and absolute humidity of the indoor air, by using a calculation formula based on the psychrometric chart, and based on the calculation result, may determine whether the amount of moisture contained in the indoor air is equal to or greater than a preset reference.

Even if the relative humidity of the indoor air is high, a sufficient level of moisture may not be included in the indoor air when the indoor temperature is low. In this case, when the condensation operation and the freezing operation are simply ended by reason that the relative humidity of the indoor air is high, the amount of moisture condensed in the indoor heat exchanger 108 may not be sufficient depending on the amount of moisture contained in the indoor air.

In addition, even if the relative humidity of the indoor air is low, when the indoor temperature is high, a sufficient level of moisture may be contained in the indoor air. At this time, even though a sufficient amount of moisture for removing foreign substances is condensed and frozen in the indoor heat exchanger 108, when the condensation operation and the freezing operation are repeated by reason that the relative humidity of the indoor air is low, unnecessary power consumption may occur.

Therefore, in order to reduce unnecessary power consumption while sufficiently condensing and freezing moisture for removing foreign substances in the indoor heat exchanger 108, the air conditioner 100 may determine whether to repeat the condensation operation and the freezing operation, based on the absolute value of the amount of moisture contained in the indoor air, not on the relative humidity.

At operation S480, when the total time is equal to or longer than the operation limit time, or when the amount of moisture contained in the indoor air is equal to or greater than a preset reference, the air conditioner 100 may perform an operation of removing all condensed and frozen moisture from the indoor heat exchanger 108 (hereinafter, a complete drying operation).

For example, during the complete drying operation, the air conditioner 100 may terminate the driving of the compressor 102, and control the indoor fan 109*a* to rotate at a first speed for a first drying time. At this time, after the moisture condensed and frozen in the indoor heat exchanger 108 is thawed, all may be removed.

Meanwhile, at operation S490, when the total time is less than the operation limit time and the amount of moisture contained in the indoor air is less than a preset reference, the air conditioner 100 may perform an operation (hereinafter, a partial drying operation) of partially removing condensed and frozen moisture from the indoor heat exchanger 108.

For example, during a partial drying operation, the air conditioner 100 may terminate the driving of the compressor 102, and control the indoor fan 109*a* to rotate at a second speed for a second drying time. At this time, after the moisture condensed and frozen in the indoor heat exchanger 108 is thawed, only a portion may be removed.

Meanwhile, the second drying time may be shorter than the first drying time.

The second speed in the partial drying operation may be lower than the first speed in the complete drying operation. The second speed in the partial drying operation may be higher than the rotational speed of the indoor fan 108*a* during the freezing operation and/or condensation operation.

Figure 12:
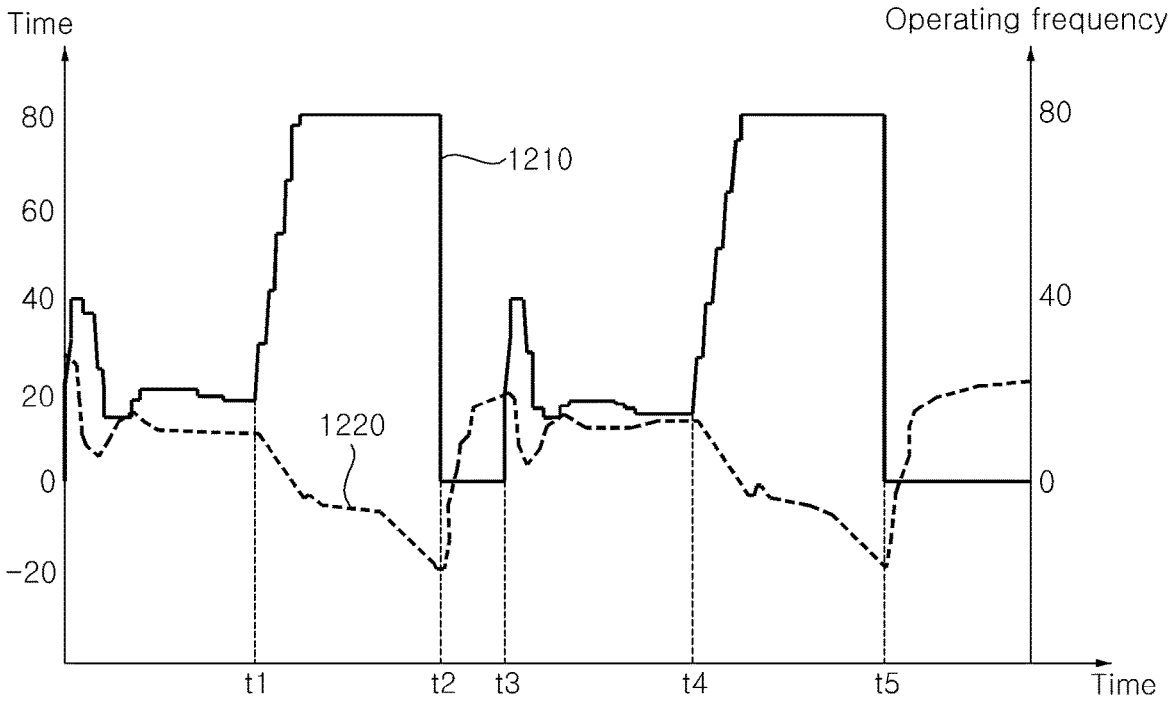

FIG. 12 is a diagram of a graph 1210 for the operating frequency of the compressor 102 and a graph 1220 for the inlet pipe temperature of the indoor unit 31.

Referring to FIG. 12, it can be seen that the air conditioner 100 performs a first condensation operation up to time t1, a first freezing operation from time t1 to time t2, a partial drying operation from time t2 to time t3, a second condensation operation from time t3 to time t4, a second freezing operation from time t4 to time t5, and a complete drying operation from time t5, respectively.

During the first and second condensation operations, the inlet pipe temperature of the indoor unit 31 may be lower than the dew point temperature during the condensation time.

During the first and second freezing operations, as the operating frequency of the compressor 102 increases, the inlet pipe temperature of the indoor unit 31 may gradually decrease. At this time, as the inlet pipe temperature of the indoor unit 31 reaches the second limit temperature (e.g., −20° C.), it can be seen that the freezing operation is terminated.

It can be seen that the second drying time for drying the moisture condensed and frozen in the indoor heat exchanger 108 during the partial drying operation is shorter than the first drying time for drying the moisture condensed and frozen in the indoor heat exchanger 108 during the complete drying operation.

Figure 13:
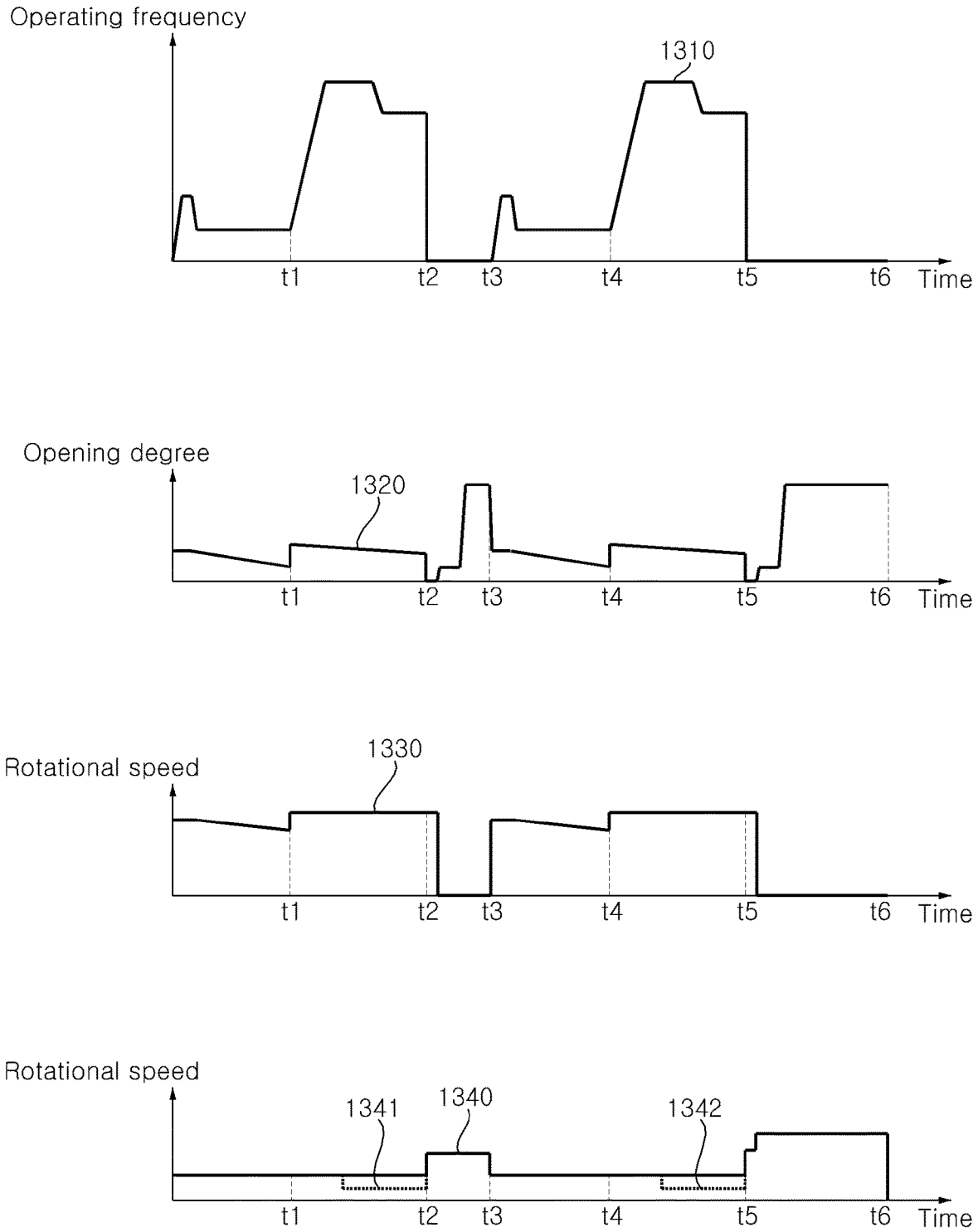

FIG. 13 is a diagram of a graph 1310 of the operating frequency of the compressor 102, a graph 1320 of the opening degree of the expansion valve 106, a graph 1330 of the rotational speed of the outdoor fan 105*a*, and a graph 1340 of the rotational speed of the indoor fan 109*a*.

Referring to FIG. 13, it can be seen that the air conditioner 100 performs a first condensation operation up to time t1, a first freezing operation from time t1 to time t2, a partial drying operation from time t2 to time t3, a second condensation operation from time t3 to time t4, a second freezing operation from time t4 to time t5, and a complete drying operation from time t5 to time t6, respectively.

The air conditioner 100 may start the compressor 102 so that the operating frequency of the compressor 102 reaches a certain frequency at a time when the condensation operation starts (e.g., time t3). At this time, the expansion valve 106 may be opened according to a preset reference opening degree in response to starting of the compressor 102.

In addition, while the condensation operation is being performed, the operating frequency of the compressor 102 may be adjusted according to the dew point temperature of indoor air.

In addition, while the condensation operation is being performed, identically/similarly to the control during the cooling mode for cooling the room, the opening degree of the expansion valve 106 and/or the rotational speed of the outdoor fan 105*a* may be adjusted in response to the operating frequency of the compressor 102.

In addition, while the condensation operation is being performed, the rotational speed of the indoor fan 109*a* may be maintained constant. In this case, the constant rotational speed of the indoor fan 109*a* may be equal to or less than the lowest rotational speed of the indoor fan 109*a* in the cooling mode.

Meanwhile, when the opening degree of the expansion valve 106 is less than the reference opening degree at the time when the freezing operation starts (e.g., time t1), it can be seen that the expansion valve 106 is opened in response to the reference opening degree.

While the freezing operation is being performed, the air conditioner 100 may increase the operating frequency of the compressor 102 so that the temperature of the indoor heat exchanger 108 is lowered according to the target freezing temperature.

The air conditioner 100 may control the operating frequency of the compressor 102 to be lowered by a certain level, when the compression ratio of the compressor 102 exceeds the reference compression ratio during the freezing operation. At this time, while the freezing operation is being performed, the operating frequency of the compressor 102 may be equal to or higher than a preset minimum frequency.

In addition, while the freezing operation is being performed, the opening degree of the expansion valve 106 may be adjusted in response to the inlet/outlet superheat degree.

In addition, while the freezing operation is being performed, the rotational speed of the outdoor fan 105*a* may maintain a preset maximum speed.

In addition, while the freezing operation is being performed, the rotational speed of the indoor fan 109*a* may be maintained constant at the rotational speed in the condensation operation.

At this time, according to a certain condition, for example, after a certain time (e.g., 12 minutes) is elapsed from the time when the freezing operation is started, when the current temperature of the indoor heat exchanger 108 is equal to or higher than a preset upper limit temperature, the constant rotational speed (e.g., 200 rpm) of the indoor fan 109*a* may be lowered to a preset rotational speed (e.g., 150 rpm) (1341, 1342).

Meanwhile, the air conditioner 100 may stop the operation of the compressor 102 and the outdoor fan 105*a*, when the partial drying operation and the complete drying operation are performed. At this time, the operation of the outdoor fan 105*a* may be stopped after a certain time is elapsed from a point in time when the freezing operation is terminated.

In addition, the air conditioner 100 may close the opening of the expansion valve 106 when the freezing operation is terminated.

In addition, the air conditioner 100 may partially open the opening of the expansion valve 106 after a certain time is elapsed from the point in time when the freezing operation is terminated, and then, may fully open the expansion valve 106 until the compressor 102 is started.

The indoor fan 109*a* may rotate at a rotational speed higher than the rotational speed in the condensation operation and the freezing operation, while the partial drying operation is being performed. In addition, the indoor fan 109*a* may rotate at a rotational speed higher than the rotational speed in the partial drying operation, while the complete drying operation is being performed.

Figure 14:
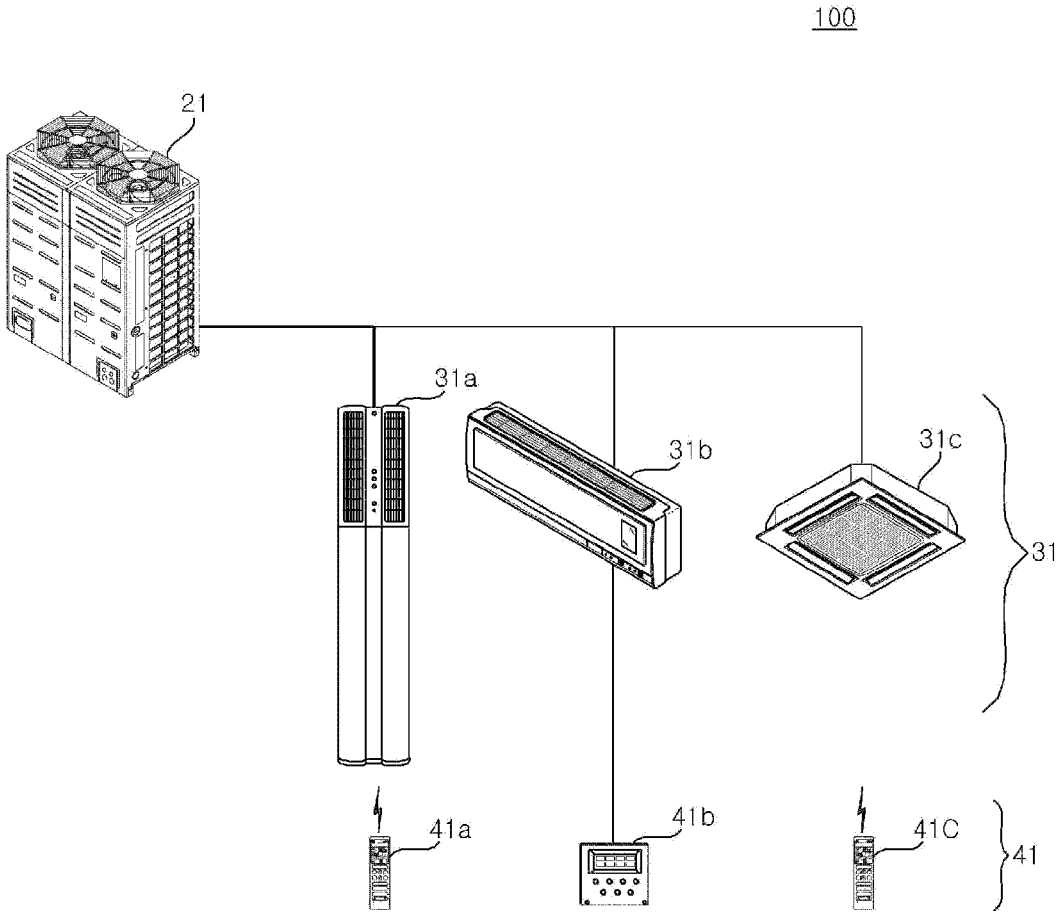
FIGS. 14 and 15 are diagrams illustrating an example of a configuration of an air conditioner including a plurality of indoor units according to an embodiment of the present disclosure.
Figure 15:
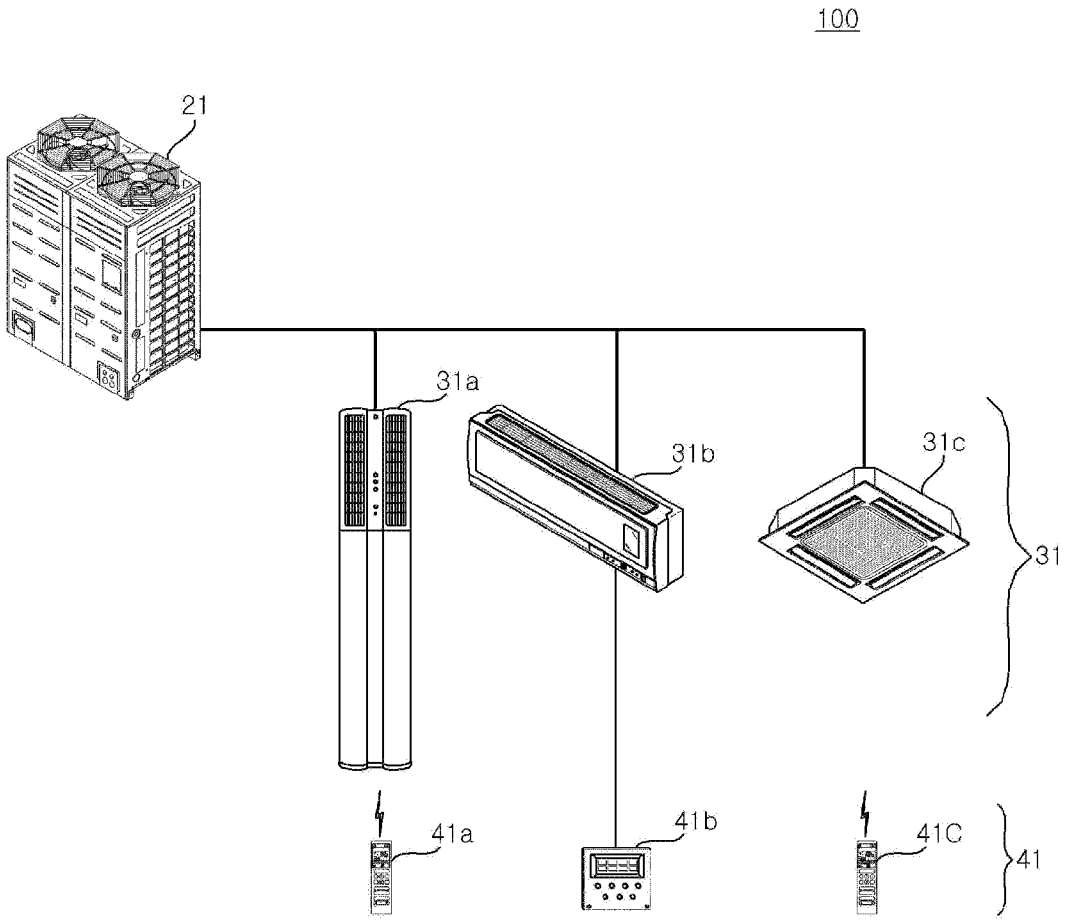

FIGS. 14 and 15 are diagrams illustrating an example of a configuration of an air conditioner including a plurality of indoor units according to an embodiment of the present disclosure.

Referring to FIG. 14, the air conditioner 100 may include a plurality of indoor units 31 connected to the outdoor unit 21. For example, the air conditioner 100 may include a stand-type indoor unit 31*a*, a wall-mounted indoor unit 31*b*, and/or a ceiling-type indoor unit 31*c*.

The plurality of remote controllers 41 are respectively connected to the plurality of indoor units 31, transmit a user's control command to the indoor unit 31, and receive and display state information of the indoor units 31. At this time, each of the plurality of remote controllers 41 may communicate with a corresponding indoor unit 31 in a wired or wireless manner according to a connection type.

The air conditioner 100 may perform an operation (e.g., a condensation operation or a freezing operation) for removing foreign substances from at least one of the plurality of indoor units 31. At this time, among the plurality of indoor units 31, the power of the remaining indoor units excluding the indoor unit which performs the operation for removing the foreign substances may be turned off.

For example, when the air conditioner 100 performs an operation for removing foreign substances with respect to the stand-type indoor unit 31*a*, the power of the wall-mounted indoor unit 31*b* and the ceiling-type indoor unit 31*c* may be turned off. At this time, the refrigerant supplied from the outdoor unit 21 may be transmitted only to the stand-type indoor unit 31*a*, and may not be transmitted to the wall-mounted indoor unit 31*b* and the ceiling-type indoor unit 31*c*.

Meanwhile, referring to FIG. 15, the air conditioner 100 may perform an operation for removing foreign substances from all of the plurality of indoor units 31. At this time, the refrigerant supplied from the outdoor unit 21 may be transmitted to all of the plurality of indoor units 31, and operations for removing foreign substances (e.g., condensation operation and freezing operation) may be simultaneously performed in the plurality of indoor units 31.

As described above, according to at least one of the embodiments of the present disclosure, moisture contained in the indoor air is condensed, frozen, and dried on the surface of the indoor heat exchanger 108 step by step, thereby effectively removing foreign substances adsorbed on the indoor heat exchanger 108.

In addition, according to at least one of the embodiments of the present disclosure, the amount of moisture condensed in the indoor heat exchanger 108 can be increased by adjusting the operating frequency of the compressor 102 to correspond to the dew point temperature of indoor air.

In addition, according to at least one of the embodiments of the present disclosure, damage to the compressor 102 that may occur during freezing of moisture condensed in the indoor heat exchanger 108 can be prevented, by adjusting the operating frequency of the compressor 102 based on the compression ratio of the compressor 102.

In addition, according to at least one of the embodiments of the present disclosure, moisture can be uniformly frozen in the entire area of the indoor heat exchanger 108, and foreign substances can be uniformly removed with respect to the entire area of the indoor heat exchanger 108.

In addition, according to at least one of the embodiments of the present disclosure, the foreign substances adsorbed on the indoor heat exchanger can be more effectively removed, by repeating the operation of removing the foreign substances adsorbed on the indoor heat exchanger 108, according to the amount of moisture contained in the indoor air.

Since the accompanying drawings are merely for easily understanding embodiments disclosed herein, it should be understood that the technical spirit disclosed herein is not limited by the accompanying drawings, and all changes, equivalents or substitutions are included in the spirit and technical scope of the present disclosure.

Likewise, although operations are shown in a specific order in the drawings, it should not be understood that the operations are performed in the specific order shown in the drawings or in a sequential order so as to obtain desirable results, or all operations shown in the drawings are performed. In certain cases, multitasking and parallel processing may be advantageous.

Although the present disclosure has been described with reference to specific embodiments shown in the drawings, it is apparent to those skilled in the art that the present description is not limited to those exemplary embodiments and is embodied in many forms without departing from the scope of the present disclosure, which is described in the following claims. These modifications should not be individually understood from the technical spirit or scope of the present disclosure.

The invention claimed is:

1. An air conditioner, comprising:

a compressor configured to compress and discharge a refrigerant;

an indoor heat exchanger configured to exchange heat between the refrigerant and indoor air;

an indoor fan;

a sensor unit including at least one sensor; and a controller configured to control the compressor so that a current temperature of the indoor heat exchanger corresponds to a target temperature, wherein the controller is further configured to:

perform a primary control of the compressor, using a first target temperature as the target temperature corresponding to a dew point temperature of the indoor air and the current temperature of the indoor heat exchanger;

perform a secondary control of the compressor, using a second target temperature below 0° C. as the target temperature, which is lower than the first target temperature and the current temperature of the indoor heat exchanger;

when an amount of moisture contained in the indoor air corresponding to absolute humidity is equal to or greater than a preset reference, perform a first drying operation; and when the amount of moisture contained in the indoor air is less than the preset reference, perform a second drying operation and repeatedly perform at least one of the primary control or the secondary control, wherein the first drying operation and the second drying operation are different in at least one of a rotational speed of the indoor fan or a rotational time of the indoor fan.

2. The air conditioner of claim 1, wherein the at least one sensor comprises a sensor that detects a state of the indoor air, and wherein the controller is configured to:

calculate the dew point temperature based on the state of the indoor air detected by the sensor; and determine a temperature lower than the dew point temperature by a certain temperature as the first target temperature.

3. The air conditioner of claim 1, wherein the controller is further configured to:

calculate a ratio of a discharge pressure to a suction pressure of the compressor as a compression ratio;

maintain the second target temperature when the calculated compression ratio is less than or equal to a preset reference compression ratio; and increase the second target temperature when the calculated compression ratio exceeds the reference compression ratio, and wherein the increased second target temperature is below 0° C. and lower than the first target temperature.

4. The air conditioner of claim 3, wherein the controller is configured to:

determine whether the current temperature of the indoor heat exchanger is lower than a preset first limit temperature when the calculated compression ratio is less than or equal to the reference compression ratio;

increase the second target temperature when the current temperature of the indoor heat exchanger is lower than the first limit temperature; and maintain the second target temperature when the current temperature of the indoor heat exchanger is equal to or higher than the first limit temperature.

5. The air conditioner of claim 3, wherein the controller is configured to:

when a frequency corresponding to the increased second target temperature is equal to or less than a preset minimum frequency, set the minimum frequency as an operating frequency of the compressor; and when the frequency corresponding to the increased second target temperature exceeds the minimum frequency, set the frequency corresponding to the increased second target temperature as the operating frequency of the compressor.

6. The air conditioner of claim 1, further comprising an expansion valve that expands the refrigerant flowing into the indoor heat exchanger, wherein the controller is further configured to:

when the secondary control is started, check whether an opening degree of the expansion valve is less than a preset reference opening; and when the opening degree of the expansion valve is less than the reference opening degree, control the expansion valve to be opened according to the reference opening degree.

7. The air conditioner of claim 6, wherein the reference opening degree corresponds to the opening degree of the expansion valve at a time when a starting operation of the compressor is completed.

8. The air conditioner of claim 1, further comprising:

an expansion valve configured to expand the refrigerant flowing into the indoor heat exchanger, wherein the at least one sensor comprises:

a first temperature sensor configured to detect an inlet pipe temperature of the indoor heat exchanger; and a second temperature sensor configured to detect an outlet pipe temperature of the indoor heat exchanger, wherein the controller is further configured to determine an opening degree of the expansion valve based on a result value obtained by subtracting the inlet pipe temperature from the outlet pipe temperature.

9. The air conditioner of claim 8, wherein the controller is further configured to:

when the result value is equal to or greater than a preset first level, increase the opening degree of the expansion valve;

when the result value is less than a second level lower than the first level, decrease the opening degree of the expansion valve; and when the result value is less than the first level and greater than or equal to the second level, maintain the opening degree of the expansion valve.

10. The air conditioner of claim 1, wherein the at least one sensor comprises a sensor that detects a state of the indoor air, wherein the controller is configured to:

calculate a wet bulb temperature corresponding to an amount of moisture contained in the indoor air based on the state of the indoor air detected by the sensor; and when the wet bulb temperature is lower than a preset temperature value, repeatedly perform the primary control and the secondary control.

11. A method of operating an air conditioner, the method comprising:

performing a primary control of a compressor included in the air conditioner, based on a first target temperature corresponding to a dew point temperature of an indoor air and a current temperature of an indoor heat exchanger included in the air conditioner;

performing a secondary control of the compressor, based on a second target temperature below 0° C., which is lower than the first target temperature and the current temperature of the indoor heat exchanger;

determining that an amount of moisture contained in the indoor air corresponding to absolute humidity is equal to or greater than a preset reference and, in response to this determination performing a first drying operation; and determining that the amount of moisture contained in the indoor air is less than the preset reference and, in response to this determination performing a second drying operation and determining whether to repeatedly performing at least one of the primary control or the secondary control, wherein the first drying operation and the second drying operation are different in at least one of a rotational speed of an indoor fan or a rotational time of the indoor fan.

12. The method of claim 11, wherein the performing of the primary control of the compressor comprises:

calculating the dew point temperature based on a state of the indoor air detected through at least one sensor; and determining a temperature lower than the dew point temperature by a certain temperature as the first target temperature.

13. The method of claim 11, wherein the performing of the secondary control of the compressor comprises:

calculating a ratio of a discharge pressure to a suction pressure of the compressor as a compression ratio;

maintaining the second target temperature when the calculated compression ratio is less than or equal to a preset reference compression ratio; and increasing the second target temperature when the calculated compression ratio exceeds the reference compression ratio, and wherein the increased second target temperature is below 0° C. and lower than the first target temperature.

14. The method of claim 13, wherein the performing of the secondary control of the compressor further comprises:

determining whether the current temperature of the heat exchanger is lower than a preset first limit temperature when the calculated compression ratio is less than or equal to the reference compression ratio;

increasing the second target temperature when the current temperature of the heat exchanger is lower than the first limit temperature; and maintaining the second target temperature when the current temperature of the heat exchanger is equal to or higher than the first limit temperature.

15. The method of claim 13, wherein the performing of the secondary control of the compressor further comprises:

when a frequency corresponding to the increased second target temperature is equal to or less than a preset minimum frequency, setting the minimum frequency as an operating frequency of the compressor; and when the frequency corresponding to the increased second target temperature exceeds the minimum frequency, setting the frequency corresponding to the increased second target temperature as the operating frequency of the compressor.

16. The method of claim 11, further comprising:

checking whether an opening degree of an expansion valve included in the air conditioner is less than a preset reference opening degree when the secondary control is started; and opening the expansion valve according to the reference opening degree when the opening degree of the expansion valve is less than the reference opening degree.

17. The method of claim 16, wherein the reference opening degree corresponds to the opening degree of the expansion valve at a time when a starting operation of the compressor is completed.

18. The method of claim 11, wherein the performing of the secondary control of the compressor comprises determining an opening degree of the expansion valve based on a result value obtained by subtracting an inlet pipe temperature from an outlet pipe temperature of the indoor heat exchanger.

19. The method of claim 18, wherein the determining of the opening degree of the expansion valve comprises:

increasing the opening degree of the expansion valve when the result value is equal to or greater than a preset first level;

decreasing the opening degree of the expansion valve when the result value is less than a second level lower than the first level; and maintaining the opening degree of the expansion valve when the result value is less than the first level, and greater than or equal to the second level.

20. The method of claim 11, wherein the determining of whether to repeatedly perform at least one of the primary control or the secondary control comprises:

calculating a wet bulb temperature corresponding to an amount of moisture contained in the indoor air based on the state of the indoor air detected by at least one sensor; and repeatedly performing the primary control and the secondary control when the wet bulb temperature is lower than a preset temperature value.

* * * * *